US012442258B2

(12) United States Patent
Koh

(10) Patent No.: US 12,442,258 B2
(45) Date of Patent: Oct. 14, 2025

(54) SELF CENTRALIZING, SEEK AND SHIFTING APPARATUS WITH SUSPENSION SYSTEM

(71) Applicant: Halliburton Energy Services, Inc., Houston, TX (US)

(72) Inventor: Chong Yong Koh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 51 days.

(21) Appl. No.: 18/528,201

(22) Filed: Dec. 4, 2023

(65) Prior Publication Data

US 2024/0426180 A1 Dec. 26, 2024

Related U.S. Application Data

(60) Provisional application No. 63/522,019, filed on Jun. 20, 2023.

(51) Int. Cl.
*E21B 17/07* (2006.01)
*E21B 17/10* (2006.01)

(52) U.S. Cl.
CPC ..... *E21B 17/07* (2013.01); *E21B 17/10* (2013.01); *E21B 17/1014* (2013.01)

(58) Field of Classification Search
CPC .. E21B 17/07; E21B 17/1014; E21B 17/1021; E21B 4/18; E21B 31/18; E21B 23/001
See application file for complete search history.

(56) References Cited

U.S. PATENT DOCUMENTS 4,557,327 A 12/1985 Kinley et al.
4,790,381 A 12/1988 Armell
5,765,640 A 6/1998 Milne et al.
(Continued)

FOREIGN PATENT DOCUMENTS

CN 109488275 A 3/2019

OTHER PUBLICATIONS

International Search Report and Written Opinion for International Patent Application No. PCT/US2023/086386 dated Aug. 27, 2024. PDF file. 10 pages.
(Continued)

*Primary Examiner* — Yong-Suk (Philip) Ro
(74) *Attorney, Agent, or Firm* — John W. Wustenberg; C. Tumey Law Group, PLLC

(57) ABSTRACT

A downhole system may include a housing securable to a conveyance, a first linkage base disposed proximate a first shoulder of the housing in a collapsed position, and a second linkage base disposed proximate a second shoulder of the housing in the collapsed position. Further, the downhole system may include a shifting key configured to move between the collapsed position and an expanded position in response to movement of the first linkage base and/or the second linkage base. The shifting key is secured to the first linkage base via a first linkage arm and to the second linkage base via a second linkage arm. The first linkage base is configured to contact the first shoulder of the housing, with the shifting key in the expanded position, to transfer a load on the shifting key to the housing through the first linkage arm and the first linkage base.

20 Claims, 12 Drawing Sheets

(56) References Cited

U.S. PATENT DOCUMENTS

| | | | | |
|---|---|---|---|---|
| 8,069,971 | B2 * | 12/2011 | Swinderman | B65G 45/16 198/499 |
| 8,485,278 | B2 * | 7/2013 | Mock | E21B 4/18 175/325.1 |
| 11,248,427 | B2 | 2/2022 | Mauchien et al. | |
| 2005/0247488 | A1 * | 11/2005 | Mock | E21B 4/18 166/212 |
| 2013/0068479 | A1 * | 3/2013 | AlDossary | E21B 4/18 166/381 |
| 2013/0113227 | A1 * | 5/2013 | Mitchell | E21B 4/18 294/86.24 |
| 2015/0211312 | A1 * | 7/2015 | Krueger, V | E21B 23/042 294/86.24 |
| 2024/0328268 | A1 * | 10/2024 | Adams | E21B 23/0419 |

OTHER PUBLICATIONS

ReSOLVE iX—Smart Shifting Tool by Schlumberger, 2023.

* cited by examiner

SELF CENTRALIZING, SEEK AND SHIFTING APPARATUS WITH SUSPENSION SYSTEM

CROSS-REFERENCE TO RELATED APPLICATIONS

The present application is a non-provisional conversion of U.S. Provisional Application Ser. No. 63/522,019, filed Jun. 20, 2023, which is herein incorporated by reference in its entirety.

BACKGROUND

In the oil and gas industry, downhole flow control devices are often employed. Such flow control devices may be adjusted remotely (e.g., using electric or hydraulic power that extends from earth's surface) or locally (e.g., using a service tool). Local adjustment of a flow control device is not a trivial matter due to issues such as remote service tool alignment with a latch interface of a downhole flow control device, latch strength, and latch durability.

Shifting tools available in the market may require multiple settings to enable their shifter to perform as intended. For example, having low seek pressure and higher shift pressure during the shifting operation. These designs are mostly hydraulic driven, which requires accumulator to enable their shifter to couple to the latching profile. Even at low pressure, the stiffness of hydraulic fluid may require higher pressure to operate the shifting tool.

BRIEF DESCRIPTION OF THE DRAWINGS

These drawings illustrate certain aspects of some of the embodiments of the present disclosure and should not be used to limit or define the method.

DETAILED DESCRIPTION

Methods and systems herein may generally relate to a service tool that employs a tool body with a shifting key. Specifically, the service tool may comprise a suspension system to enable the shifting key to run across a latching profile mechanically with minimal pressure. The suspension system may also simplify the shifting operation to single input pressure. The suspension system may "float" within the chamber with low or without pressure easing the control of the compliance of the shifting key to shifting profile. The suspension system may also enable the mechanism to self-centralize to the pipe or profile with low hydraulic pressure, de-couple from the high-pressure chamber.

Figure 1:
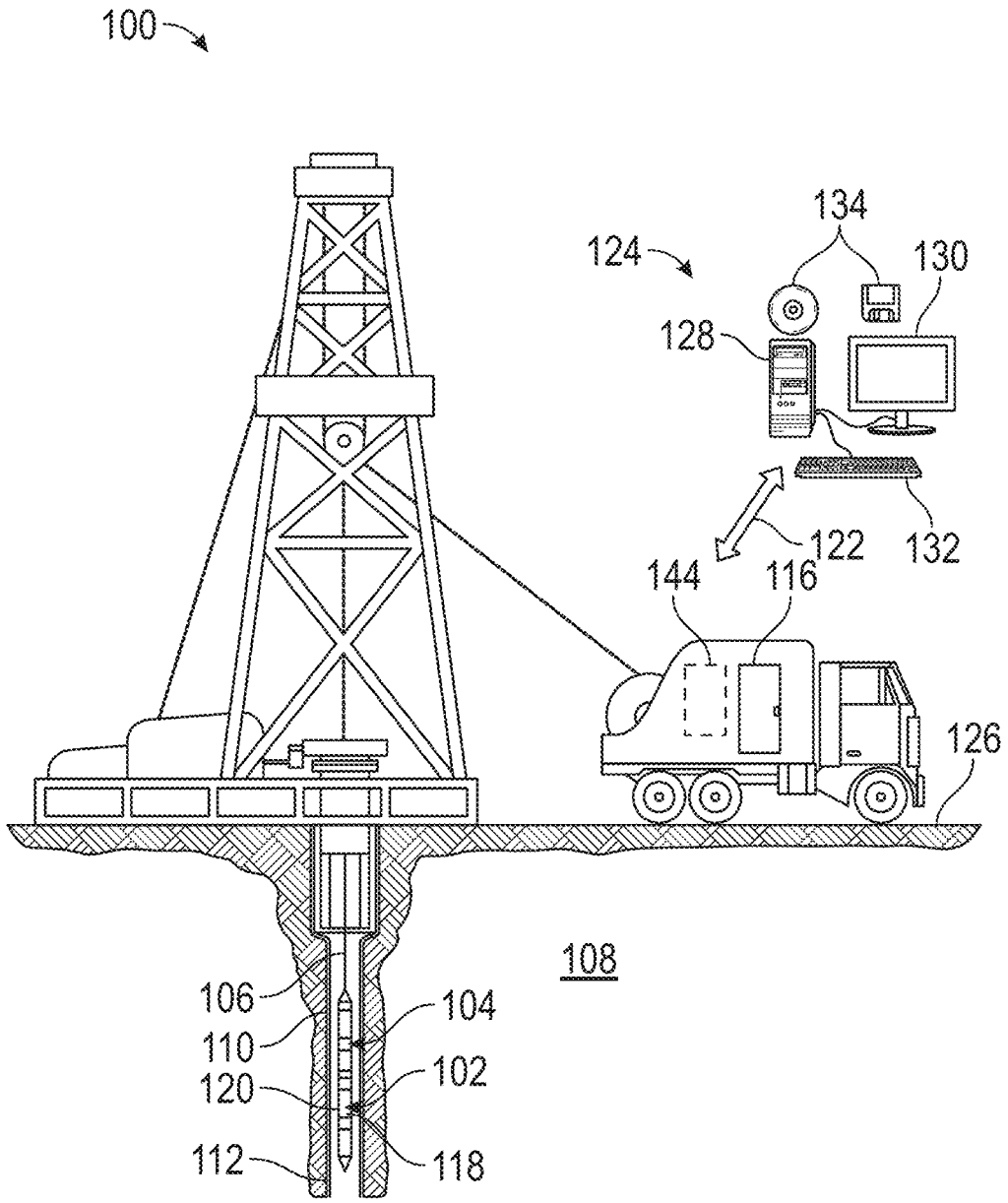
FIG. 1 illustrates a side elevation, partial cross-sectional view of an operational environment for a wellbore completion system, in accordance with some embodiments of the present disclosure.

FIG. 1 illustrates a side elevation, partial cross-sectional view of an operational environment for a wellbore completion system, in accordance with some embodiments of the present disclosure. As illustrated, the well completion system 100 may include a downhole service tool 102 (e.g., a shifting apparatus) that is run into a wellbore 104 via a conveyance 106. As illustrated, the wellbore 104 may extend through a subterranean formation 108. While the wellbore 104 is shown extending generally vertically into the subterranean formation 108, the principles described herein are also applicable to wellbores that extend at an angle through the subterranean formation 108, such as horizontal and slanted wellbores (e.g., wellbores with high inclination angles).

Further, the well completion system 100 may further include a casing 110 installed in the wellbore 104. To install the casing 110, modular casing segments are joined and lowered into the wellbore 104 until a desired casing section length is reached. Once a desired length and position for a particular casing section is achieved, cementing operations are performed, resulting in a permanent casing section installation. As needed, wellbore 104 is extended by drilling through cured cement at an installed casing section terminus. The process of installing casing sections, cementing the installed casing sections in place, and extending wellbore 104 may be repeated as desired. At selected depths within the formation 108, a flow control device 112 may be installed as part of the casing 110 (e.g., a customized casing segment) or may be part of an assembly deployed along the casing 110 (e.g., a sand control or intelligent completion assembly). In different embodiments, the flow control device 112 may be part of a sand control tool, a gravel pack tool, a valve assembly, or any other downhole tool that may be deployed downhole. The flow control device 112 may control the amount of formation fluid that may enter wellbore 104 through the casing 110. The downhole service tool 102, which is run-in-hole via the conveyance, may be utilized in shifting operations to adjust a position of the flow control device 112 (e.g., to increase or decrease flow through the flow control device 112).

As illustrated, a hoist 114 may be used to run downhole service tool 102 into the wellbore 104. The hoist 114 may be disposed on a vehicle 116 and may be used, for example, to raise and lower the conveyance 106 in the wellbore 104. While the hoist 114 is shown on the vehicle 116, the hoist 114 may alternatively be installed on the surface (e.g., not on the vehicle 116). Moreover, the downhole service tool 102 may be suspended in the wellbore 104 on the conveyance 106. Other conveyance types (e.g., coiled tubing and wired drill pipe) may be used for conveying downhole service tool 102 into wellbore 104. Further, the downhole service tool 102 may comprise a housing 118 (e.g., one or more tubulars). Further, the downhole service tool 102 may include any suitable material, including without limitation titanium, inconel, a nickel-chromium-based superalloy, a chromium alloy, a nickel alloy, stainless steel, alloys, plastic, combinations thereof, and the like. As discussed in further detail below, the downhole service tool 102 may comprise a shifting key 120 that may be extended radially from the housing 118. During operations, the downhole service tool 102 may be moved upwards and downwards to position the shifting key 120 at a target position relative to the flow control device 112. When latched to the shifting apparatus, elements of the flow control device 112 may be moved in response to the downhole service tool 102 moving (e.g., to increase or decrease flow through the flow control device 112). The operations may be controlled and/or monitored by a downhole information handling system (not illustrated). The downhole information handling system may comprise a random access memory (RAM), one or more processing units, such as a central processing unit (CPU), or hardware or software control logic, ROM, and/or other types of nonvolatile memory. The downhole service tool 102 and the downhole information handling system may be communicatively coupled via a communication link 122 with an information handling system 124 disposed at surface 126.

Any suitable technique may be used for transmitting signals from the downhole service tool 102 to the surface 126. As illustrated, a communication link 122 (which may be wired or wireless, for example) may be provided that may transmit data from the downhole service tool 102 to the information handling system 124 at the surface 126. The information handling system 124 may include a processing unit 128, a monitor 130, an input device 132 (e.g., keyboard, mouse, etc.), and/or computer media 134 (e.g., optical disks, magnetic disks) that can store code representative of the methods described herein. The information handling system 124 may act as a data acquisition system and possibly a data processing system that analyzes information from the downhole service tool 102. For example, the information handling system 124 may process the information from downhole service tool 102 to determine fluid contamination. The information handling system 124 may also determine additional properties of the fluid sample (or reservoir fluid), such as component concentrations, pressure-volume-temperature properties (e.g., bubble point, phase envelop prediction, etc.) based on the fluid characterization. This processing may occur at the surface 126 in real-time. Alternatively, processing may occur downhole or another location after recovery of the downhole service tool 102 from the wellbore 104. Alternatively, the processing may be performed by an information handling system (e.g., a fluid analysis module) in the wellbore 104. The resultant fluid contamination and fluid properties may then be transmitted to the surface 126. Further, the resultant fluid contamination and fluid properties may be transmitted to the surface 126 in real-time. As described herein, "real-time" may be generally understood to relate to a system, apparatus, or method in which a set of input data is processed and available for use within 100 milliseconds ("ms"). In further examples, the input data may be processed and available for use within 90 ms, within 80 ms, within 70 ms, within 60 ms, within 50 ms, within 40 ms, within 30 ms, within 20 ms, or any ranges therebetween. In some examples, real-time may relate to a human's sense of time rather than a machine's sense of time. For example, processing which results in a virtually immediate output, as perceived by a human, may be considered real-time processing.

Figure 2:
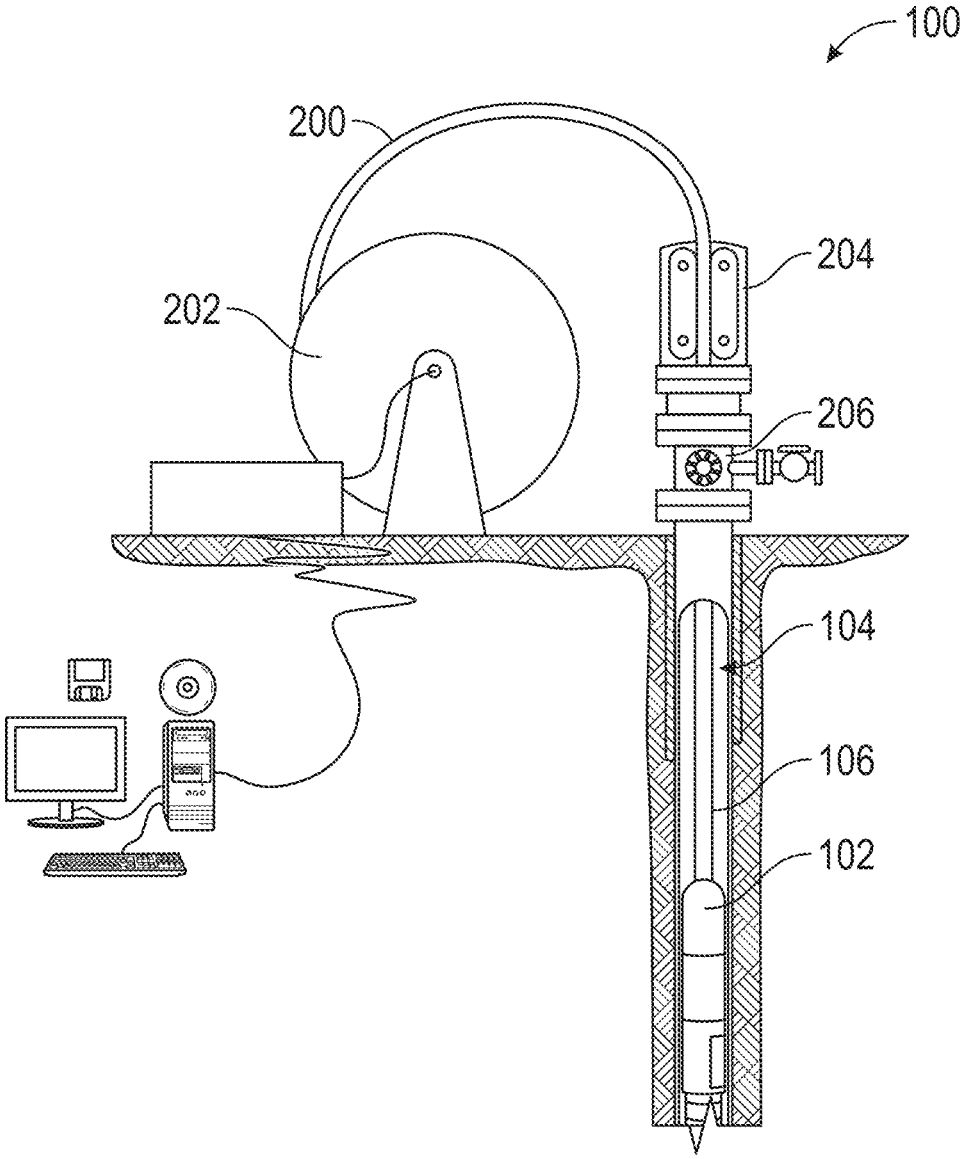
FIG. 2 illustrates a partial cross-sectional view of an operational environment using coiled tubing for a wellbore completion system, in accordance with some embodiments of the present disclosure.

FIG. 2 illustrates a partial cross-sectional view of an operational environment using coiled tubing for a wellbore completion system, in accordance with some embodiments of the present disclosure. As illustrated, the conveyance 106 of the well completion system 100 may include a coiled tubing string 200. The coiled tubing string 200 may be coupled with the downhole service tool 102. As illustrated, the coiled tubing string 200 may be coupled with the downhole service tool 102, as well as other subs and tools. For example, as illustrated, the other subs and tools may include a gamma ray sensing tool, a casing locator tool, or a pulse telemetry tool. Coiled tubing string 200 may be disposed around and/or removed from a spool 202 by a tubing injector 204 and injected into the wellbore 104 through a blowout preventer 206 such that the coiled tubing string 200 may traverse along a borehole (e.g., the wellbore 104). As shown, the wellbore 104 may be vertical. However, as detailed further below, wellbore 104 may include horizontal portions. Additionally, the wellbore 104 may include bends and turns.

In examples, coiled tubing string 200 may be a continuous length of steel, alloy steel, stainless steel, composite tubing, or other suitable metal or non-metal material that may be flexible enough to be wound on spool 202 for transportation, and spool 202 itself may be located on a coiled tubing truck for mobility (not illustrated). Due to the relative lack of joints, it may be advantageous to use coiled tubing string 200 when pumping chemicals downhole.

In wellbore 104, coiled tubing string 200 may include a sub and one or more tools coupled to coiled tubing string 200, which may make up the bottom hole assembly. The sub may control communication between uphole and downhole elements, and may also control communication between downhole elements such as the one or more tools by providing a common clock, power source, communication bus, and the like. The tools may be subs, or other sections of coiled tubing string 200, that perform functions particular to a coiled tubing operation. For example, in a perforation operation the tools may include a perforation tool including perforating guns and the like.

Figure 3:
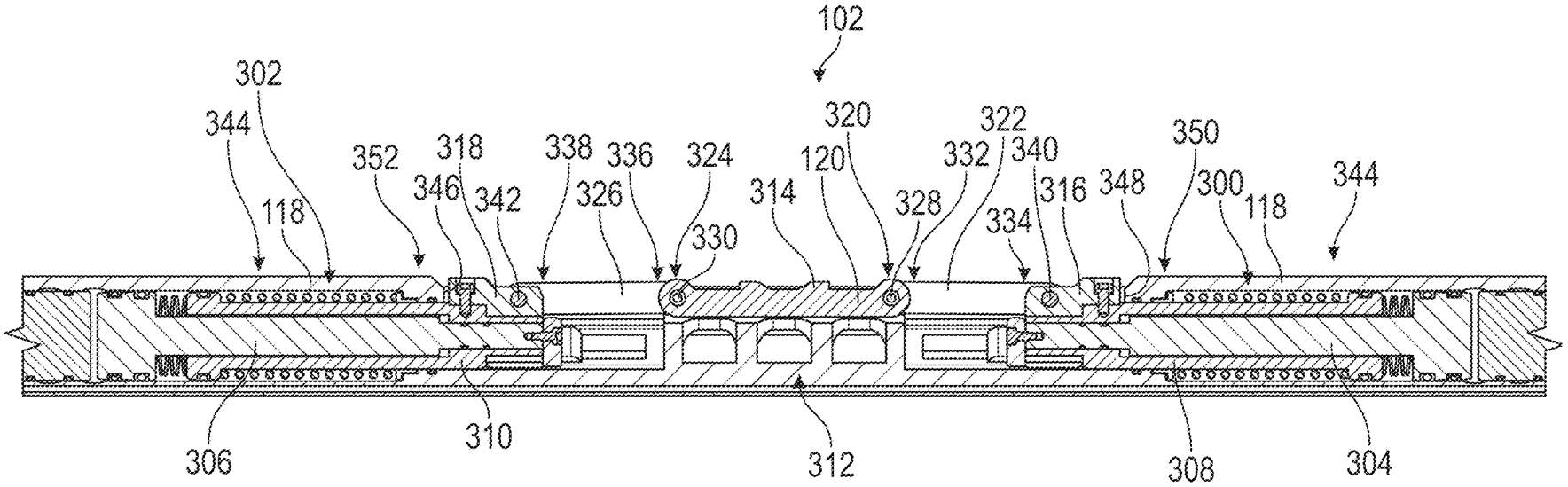
FIG. 3 illustrates a cross-sectional view of a downhole service tool having a shifting key disposed in a collapsed position, in accordance with some embodiments of the present disclosure.

FIG. 3 illustrates a cross-sectional view of a service tool having a shifting key disposed in a collapsed position, in accordance with some embodiments of the present disclosure. As set forth above, the downhole service tool 102 includes the housing 118, which is securable to the conveyance 106 (shown in FIG. 1). The housing 118 may be tubular in shape. Further, the housing 118 may include a first section 300 (e.g., lower section) and a second section 302 (e.g., upper section) configured to house respective pistons (e.g., a first piston 304 and a second piston 306), suspension rods (e.g., a first suspension rod 308 and a second suspension rod 310), etc. used for actuating the shifting key 120 during shifting operations. The shifting key 120 may be disposed along a center section 312 of the housing 118 formed between the first section 300 and the second section 302. Moreover, as set forth in below in FIG. 4, shifting operations may include deploying the shifting key 120 (e.g., radially extending the shifting key 120 from the collapsed position to an expanded position) to engage the flow control device 112 or any other suitable downhole device. Axial movement of the shifting key 120 while engaged with the flow control device 112 may operate (e.g., adjust) the flow control device 112 as shown in FIG. 5. In particular, shifting teeth 314 of the shifting key 120 may be configured engage latch teeth of a latch interface of the flow control device 112 (shown in FIG. 5). With the shifting teeth 314 engaged with the latch teeth, movement of the downhole service tool 102 along the wellbore 104 may move the latch interface, which may adjust the flow control device 112. Regarding FIG. 3, the shifting key 120 may have a single or bi-directional latching profile configured to interface with a corresponding flow control device profile. Additionally, the depth and thickness of the shifting key 120 may be based on the shifting operation to be performed. The shifting key 120, and/or other components of the downhole service tool 102, may be made up of high strength alloy steel with case hardening, nickel cobalt alloy, martensitic precipitation hardened stainless steel, etc., as such components may operate in a corrosive environment.

Moreover, the shifting key 120 may be connected to a first linkage base 316 and a second linkage base 318 of the downhole service tool 102 via respective linkage arms. For example, as illustrated, a first end 320 of the shifting key 120 may be connected to the first linkage base 316 via at least one first linkage arm 322, and a second end 324 of the shifting key 120 may be connected to the second linkage base 318 via at least one second linkage arm 326. Further, the respective linkage arms may be connected to the shifting key 120 via at least one rotational fastener (e.g., one or more pins) such that the shifting key 120 may rotate with respect to each of the respective linkage arms. For example, the first linkage arm 322 may be connected to the first end 320 of the shifting key 120 via a first key pin 328 such that the shifting key 120 may rotate with respect to the first linkage arm 322 about an axis of the first key pin 328. That is, the shifting key 120 may be configured to hinge with respect to the first linkage arm 322 about the first key pin 328. Similarly, the shifting key 120 may be configured to hinge with respect to the second linkage arm 326 about a second key pin 330.

Further, the respective linkage arms may be connected at one end to shifting key 120 and at an opposite end to a corresponding linkage base. For example, as illustrated, a first distal end 332 of the first linkage arm 322 may be connected to the first end 320 of the shifting key 120 and a first proximal end 334 of the first linkage arm 322 may be connected to a first linkage base 316. Further, a second distal end 336 of the second linkage arm 326 may be connected to the second end 324 of the shifting key 120 and a second proximal end 338 of the second linkage arm 326 may be connected to a second linkage base 318. Further, the respective linkage arms may be connected to the corresponding linkage bases via at least one rotational fastener (e.g., one or more pins) such that the respective linkage arms may rotate with respect to the corresponding linkage bases. For example, the first linkage arm 322 may be connected to the first linkage base 316 via a first base pin 340 such that the first linkage arm 322 may rotate with respect to the first linkage base 316 about an axis of the first base pin 340. That is, the first linkage arm 322 may be configured to hinge with respect to the first linkage base 316 about the first base pin 340. Similarly, the second linkage arm 326 may be configured to hinge with respect to the second linkage base 318 about a second base pin 342.

As set forth in greater detail below, the shifting key 120 may move between a collapsed position and an expanded position (shown in FIG. 4) in response to movement of the first linkage base 316 and/or the second linkage base 318. In particular, the first linkage base 316 and/or the second linkage base 318 may move axially along a center section 312 of the housing 118 in response to actuation of an actuation assembly 344 to move the shifting key 120 between the collapsed position and the expanded position. As set forth above, the first end 320 of the shifting key 120 is secured to the first linkage base 316 via at the first linkage arm 322 and the second end 324 of the shifting key 120 is secured to the second linkage base 318 via the second linkage arm 326. Further, the shifting key 120 is configured to hinge with respect to the first linkage arm 322 and the second linkage arm 326, and each of the linkage arms are configured to hinge with respect to the corresponding linkage bases. As the first linkage base 316 and the second linkage base 318 move toward each, the linkage arms may be forced to rotate about the respective base pins (e.g., the first base pin 340 and the second base pin 342) to move the respective distal ends of the linkage arms radially outward. Such rotation of the linkage arms may move the shifting key 120 radially outward from the collapsed position toward the expanded position. Further, after shifting operations are complete, the shifting key 120 may be configured to move from the expanded position toward the collapsed position in response to the first linkage base 316 and the second linkage base 318 moving away from each other along the center section 312 of the housing 118.

Moreover, as illustrated, the second linkage base 318 may be axially offset from a second shoulder 346 of the housing 118 in the collapsed position, and the first linkage base 316 may be axially offset from a first shoulder 348 of the housing 118 in the collapsed position. That is, the respective linkage bases may be floating in the center section 312 of the housing 118. The first shoulder 348 may be disposed at an upper axial end 350 of the first section 300 (e.g., the lower section) of the housing 118, and the second shoulder 346 may be disposed at a lower axial end 352 of the second section 302 (e.g., the upper section) of the housing 118.

Generally, having the linkage bases (e.g., the first linkage base 316 and the second linkage base 318) disposed in positions offset from the respective shoulders (e.g., the first shoulder 348 and the second shoulder 346) may prevent loads on the shifting key 120 from being transferred from the shifting key 120, through the respective linkage arms and linkage bases to the housing 118. As set forth in greater detail below, with the shifting key 120 in the expanded position, respective suspension rods (e.g., a first suspension rod 308 and a second suspension rod 310) of the downhole service tool 102 may provide suspension for the shifting key 120 when the linkage bases offset from the respective shoulders.

Moreover, during shifting operations, downhole service tool 102 may operate in a seeking mode (shown in FIG. 4) and/or a shifting mode (shown in FIG. 5). In the seeking mode, the actuation assembly 344 may apply a setting force on the respective linkage bases, which may be transferred to shifting key 120 through the respective linkage arms, to create a radial force on shifting key 120. Further, in the shifting mode, a shifting force generated from the shifting key engaging a completion profile may be transferred through the shifting key 120 to the housing 118 via at least one linkage arm and at least one linkage base contacting a respective shoulder of the housing 118. For example, as illustrated in FIG. 5, the first linkage base 316 may be configured to contact the first shoulder 348 of the housing 118, with the shifting key 120 in the expanded position, to transfer a load on the shifting key 120 to the housing 118 through the first linkage arm 322 and the first linkage base 316. Further, at least one linkage base may operate and function as a mounting block. That is, in the seeking mode, the at least one linkage base may transfer the setting force from the actuation assembly 344 to a corresponding linkage arm. Further, in the shifting mode, the at least one linkage base may transfer the load from linkage arm to housing 118 via contact between the at least one linkage base and a corresponding shoulder of the housing 118.

Figure 4:
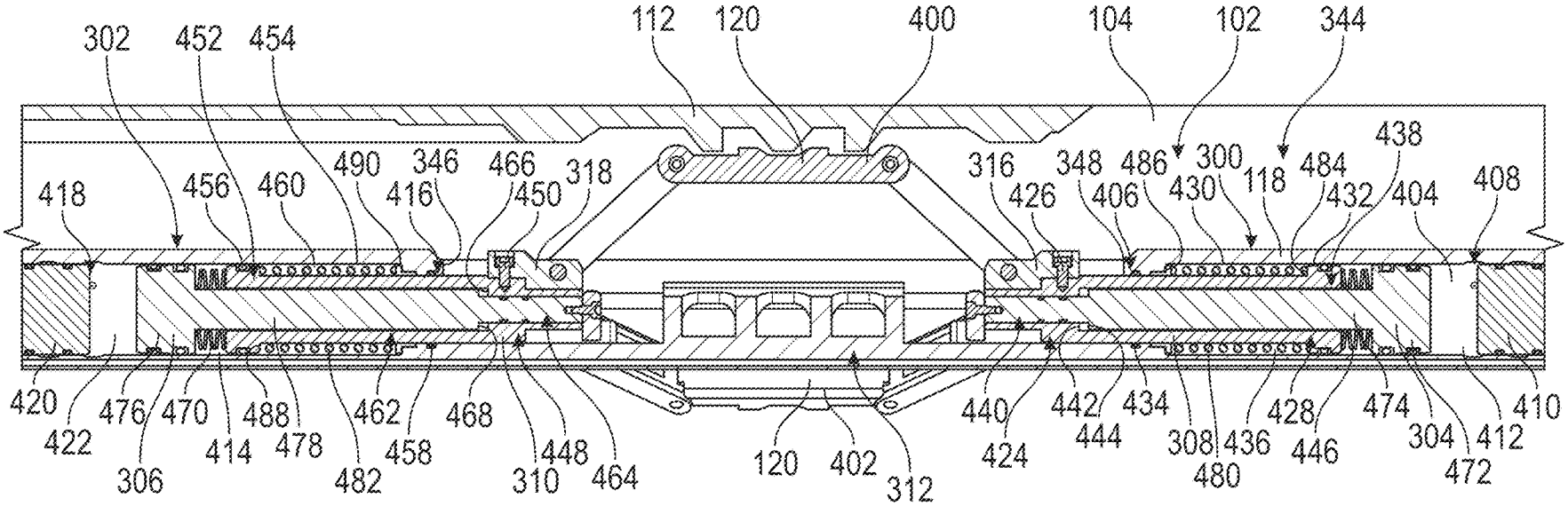
FIG. 4 illustrates a cross-sectional view of the downhole service tool having at least one piston driving the shifting key toward a deployed position, in accordance with some embodiments of the present disclosure.
Figure 5:
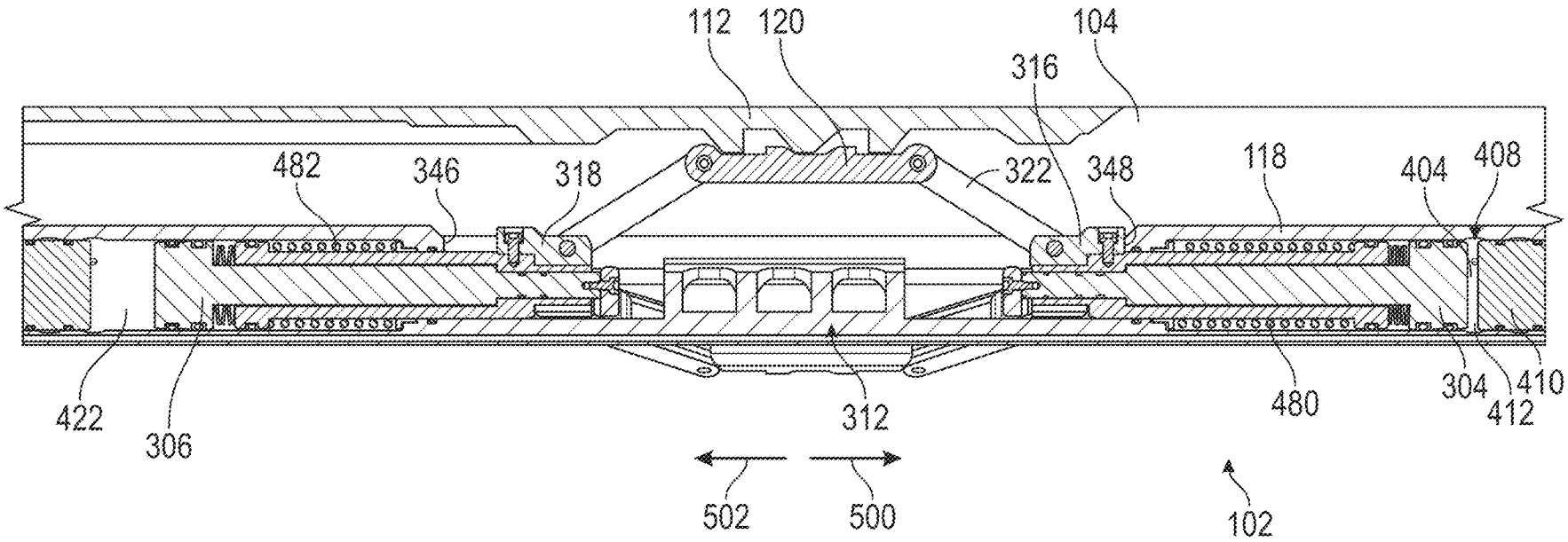
FIG. 5 illustrates a cross-sectional view of the downhole service tool with the shifting key disposed in the deployed position to actuate a flow control device, in accordance with some embodiments of the present disclosure.

FIG. 4 illustrates a cross-sectional view of the downhole service tool having at least one piston driving the shifting key toward an expanded position, in accordance with some embodiments of the present disclosure. As set forth above, the downhole service tool 102 includes the shifting key 120 configured to move between the collapsed position (e.g., a travel position) shown in FIG. 3 and the expanded position for engaging a downhole tool (e.g., the flow control device 112). In the collapsed position, the shifting key 120 may be retracted toward the center section 312 of the housing 118 of the downhole service tool 102. With the shifting key 120 disposed within and/or against the housing 118 of the downhole service tool 102, the shifting key 120 may be unable to engage the flow control device 112 such that the downhole service tool 102 may move freely along the wellbore and/or past the flow control device 112. Also, with shifting key 120 in the collapsed position, an outer surface of the housing 118 may extend radially outward beyond the profile of shifting key 120 to act as a mechanical guard to prevent or block the shifting key 120 from engaging the flow control device 112. However, as illustrated, the shifting key 120 may be extended radially outward from the housing 118 in the expanded position. Further, in the expanded position, the shifting key 120 may be positioned to engage the flow control device 112.

Also, in the expanded position, each shifting key 120 of the downhole service tool 102 may help to centralize the housing 118 within wellbore 104. That is, the downhole service tool 102 may include a plurality of shifting keys 120. For example, the downhole service tool 102 may include a first shifting key 400, a second shifting key 402, and a third shifting key (shown in FIG. 11B). Each shifting key 120 may be spaced apart equally about the circumference of the downhole service tool 102 such that one of the plurality of shifting keys 120 may contact a wellbore wall, casing, or other suitable tubular in response to the downhole service tool 102 moving laterally within the wellbore 104. Such contact may prevent further lateral movement of the downhole service tool 102 to help centralize the downhole service tool 102 in the wellbore 104.

Moreover, as set forth above, the shifting key 120 may be configured to move toward the expanded position in response to the first linkage base 316 and the second linkage base 318 moving toward each other along the center section 312 of the housing 118. The actuation assembly 344 may be configured to drive such movement of the respective linkage bases. As illustrated, the actuation assembly 344 may include the first piston 304 for driving movement of the first linkage base 316 and a second piston 306 for driving movement of the second linkage base 318.

The first piston 304 may be at least partially disposed within the first section 300 of the housing 118. As illustrated, the first section 300 of the housing 118 may include a first cavity 404 for housing at least a portion of the first piston 304. Further, the first cavity 404 may include a first inner axial end 406 disposed adjacent the center section 312 and a first outer axial end 408 disposed opposite the first inner axial end 406. The first inner axial end 406 may be open such that at least a portion of the first piston 304 may move through the first inner axial end 406 and into the center section 312. Further, the first cavity 404 may be sealed at the first outer axial end 408 via a first end feature 410. Moreover, the first piston 304 may be configured to actuate toward the center section 312 of the housing 118 in response to pressurization of a first hydraulic chamber (e.g., a first outer hydraulic chamber 412) of the first section 300. Such movement of the first piston 304 may drive the first linkage base 316 to move axially along the center section 312 of the housing 118. Additionally, in both the collapsed position and the expanded position, the first piston 304 is axially offset from the first end feature 410 of the shifting key 120 such that a load on the shifting key 120 is not transferred to the housing 118 through the first piston 304. Instead, with the first linkage base 316 engaged with the first shoulder 348 and the second linkage base 318 offset from the second shoulder 346, the entire load may be transferred to the housing 118 via the interface between the first linkage base 316 and the corresponding first shoulder 348 of the housing 118 (shown in FIG. 5).

Similarly, the second piston 306 may be at least partially disposed within the second section 302 of the housing 118. As illustrated, the second section 302 of the housing 118 may include a second cavity 414 for housing at least a portion of the second piston 306. Further, the second cavity 414 may include a second inner axial end 416 disposed adjacent the center section 312 and a second outer axial end 418 disposed opposite the second inner axial end 416. The second inner axial end 416 may be open such that at least a portion of the second piston 306 may move through the second inner axial end 416 and into the center section 312. Further, the second cavity 414 may be sealed at the second outer axial end 418 via a second end feature 420. Moreover, the second piston 306 may be configured to actuate toward the center section 312 of the housing 118 in response to pressurization of a second hydraulic chamber (e.g., a second outer hydraulic chamber 422) of the second section 302. Such movement of the second piston 306 may drive the second linkage base 318 to move axially along the center section 312 of the housing 118. Additionally, the second piston 306 is axially offset from the second end feature 420 in the collapsed position and the expanded position of the shifting key 120 such that a load on the shifting key 120 is not transferred to the housing 118 through the second piston 306. As set forth above, the first linkage base 316 may be engaged with the first shoulder 348 and the second linkage base 318 may be offset from the second shoulder 346. However, based at least in part on the load direction on the shifting key 120, the first linkage base 316 may alternatively be offset from the first shoulder 348 and the second linkage base 318 may be engaged with the second shoulder 346 such that the entire load may be transferred to the housing 118 via the interface between the second linkage base 318 and the corresponding second shoulder 346 of the housing 118.

Moreover, as illustrated, the actuation assembly 344 may further include the first suspension rod 308 and a second suspension rod 310. The first suspension rod 308 includes a first proximal end 424 that may be rigidly secured to the first linkage base 316 via at least one first fastener 426 (e.g., bolt, screw, etc.) such that the first linkage base 316 moves in response to movement of the first suspension rod 308. A first distal end 428 of the first suspension rod 308 may be disposed within the first section 300 of the housing 118. In particular, the first distal end 428 may be disposed within the first cavity 404 of the first section 300. Further, the first distal end 428 may be sealed against a first radially inner surface 430 of the first cavity 404. For example, a first outer slide ring 432 (e.g., O-ring) may be disposed about the first distal end 428 such that a fluid tight barrier is formed between the first suspension rod 308 and the first radially inner surface 430 of the first cavity 404. The first outer slide ring 432 may be configured to maintain the fluid tight barrier during movement of the first suspension rod 308. Further, a first inner slide ring 434 may be secured to the first radially inner surface 430 of the first cavity 404 at the of the first inner axial end 406 of the first cavity 404. The first inner slide ring 434 may also form a fluid tight barrier between the first suspension rod 308 and the first radially inner surface 430 of the first cavity 404. A first inner hydraulic chamber 436 may be defined as a portion of the first cavity 404 disposed between the first outer slide ring 432 and the first inner slide ring 434, as well as between the first suspension rod 308 and the first radially inner surface 430 of the first cavity 404. As set forth in greater detail below, the first inner hydraulic chamber 436 may be pressurized to drive movement of the first linkage base 316 toward the first shoulder 348.

Further, the first suspension rod 308 may include a first bore 438 configured to house at least a portion of the first piston 304. As illustrated, at least an inner portion 440 of the first piston 304 may be disposed within the first bore 438 of the first suspension rod 308. Further, as set forth above, actuation of the first piston 304 is configured to drive the first suspension rod 308 to move axially with respect to the housing 118. In particular, the first suspension rod 308 may include a first inner rod shoulder 442 formed within the first bore 438, and the first piston 304 may include a first inner piston shoulder 444 formed at the inner portion 440 of the first piston 304. As the first piston 304 moves axially toward the center section 312, the first inner piston shoulder 444 is configured to engage the first inner rod shoulder 442 such that the first piston 304 may drive the first suspension rod 308 to move axially. However, any suitable interface may be formed between the first piston 304 and the first suspension rod 308 to permit the first piston 304 to drive axial movement of the first suspension rod 308. Further, as set forth in greater detail below, actuation of the first piston 304 may additionally, or alternatively, drive a first suspension spring 446 into the first suspension rod 308 to drive the first suspension rod 308 to move axially toward the center section 312.

Moreover, the second suspension rod 310 includes a second proximal end 448 that may be rigidly secured to the second linkage base 318 via at least one second fastener 450 (e.g., bolt, screw, etc.) such that movement of the second suspension rod 310 drives movement of the second linkage base 318. A second distal end 452 of the second suspension rod 310 may be disposed within the second section 302 of the housing 118. In particular, the second distal end 452 may be disposed within the second cavity 414 of the second section 302. Further, the second distal end 452 may be sealed against a second radially inner surface 454 of the second cavity 414. For example, a second outer slide ring 456 (e.g., O-ring) may be disposed about the second distal end 452 such that a fluid tight barrier is formed between the second suspension rod 310 and the second radially inner surface 454 of the second cavity 414. The second outer slide ring 456 may be configured to maintain the fluid tight barrier during movement of the second suspension rod 310. Further, a second inner slide ring 458 may be secured to the second radially inner surface 454 of the second cavity 414 at the of the second inner axial end 416 of the second cavity 414. The second inner slide ring 458 may also form a fluid tight barrier between the second suspension rod 310 and the second radially inner surface 454 of the second cavity 414. A second inner hydraulic chamber 460 may be defined as a portion of the second cavity 414 disposed between the second outer slide ring 456 and the second inner slide ring 458, as well as between the second suspension rod 310 and the second radially inner surface 454 of the second cavity 414. As set forth in greater detail below, the second inner hydraulic chamber 460 may be pressurized to drive movement of the second linkage base 318 toward the second shoulder 346.

Further, the second suspension rod 310 may include a second bore 462 configured to house at least a portion of the second piston 306. As illustrated, at least an inner portion 464 of the second piston 306 may be disposed within the second bore 462 of the second suspension rod 310. Further, as set forth above, actuation of the second piston 306 is configured to drive the second suspension rod 310 to move axially with respect to the housing 118. In particular, the second suspension rod 310 may include a second inner rod shoulder 466 formed within the second bore 462, and the second piston 306 may include a second inner piston shoulder 468 formed on the inner portion 464 of the second piston 306. As the second piston 306 moves axially toward the center section 312, the second inner piston shoulder 468 is configured to engage the second inner rod shoulder 466 such that the second piston 306 may drive the second suspension rod 310 to move axially. However, any suitable interface may be formed between the second piston 306 and the second suspension rod 310 to permit the second piston 306 to drive axial movement of the second suspension rod 310. Further, as set forth in greater detail below, actuation of the second piston 306 may additionally, or alternatively, drive a second suspension spring 470 into the second suspension rod 310 to drive the second suspension rod 310 to move axially toward the center section 312.

The actuation assembly 344 may further include the first suspension spring 446 and the second suspension spring 470. The first suspension spring 446 may be disposed between the first distal end 428 of the first suspension rod 308 and a first piston shoulder 472 of the first piston 304. The first suspension spring 446 may include any suitable spring or biasing mechanism for biasing the first suspension rod 308 away from the first piston 304. For example, the first suspension spring 446 may include a compression spring disposed around a first shaft portion 474 of the first piston 304. Further, the first suspension spring 446 may enable suspension of the first suspension rod 308 as the shifting key 120 navigates across a shifting profile of flow control device 112. Indeed, the first suspension spring 446 may compress and expand based on the amount of force utilized to operate the downhole service tool 102.

The second suspension spring 470 may be disposed between the second distal end 452 of the second suspension rod 310 and a second piston shoulder 476 of the second piston 306. Similarly, the second suspension spring 470 may include any suitable spring or biasing mechanism for biasing the second suspension rod 310 away from the second piston 306. For example, the second suspension spring 470 may include a compression spring disposed around a second shaft portion 478 of the second piston 306. However, any suitable spring or combination of springs may be used. Further, in the seeking mode, the second suspension spring 470 may enable suspension of the first suspension rod 308 as the shifting key 120 navigates across the shifting profile of flow control device 112. That is, the second piston 306 may actuate to drive the shifting key 120 into contact with the flow control device 112 but may cease to actuate in response to contact between the shifting key 120 and the flow control device 112 such that the second suspension spring 470 remains in an uncompressed or partially compressed state. In the uncompressed or partially compressed state, the second suspension spring 470 may provide suspension via compressing and decompressing as the shifting key 120 navigates across a shifting profile of flow control device 112 so that the shifting key 120 may move radially inward and outward along the shifting profile.

However, in the shifting mode with the shifting key 120 disposed in the expanded position and the first linkage base 316 engaging the first shoulder 348 of the housing 118, the second suspension spring 470 may be fully compressed to minimize or eliminate the suspension provide by the second suspension spring 470 such that the shifting key 120 may remain engaged with the shifting profile of the flow control device 112. In particular, the second piston 306 may drive the second suspension spring 470 into the second suspension rod 310 to move the second linkage base 318 toward the first linkage base 316, which may drive the shifting key 120 toward expanded position to engage the flow control device 112. In the shifting mode, once the shifting key 120 contacts the flow control device 112, the second piston 306 may continue to actuate toward the center section 312 to compress the second suspension spring 470 to a fully compressed state. In the fully compressed state, the second suspension spring 470 may no longer compress to provide suspension for the shifting key 120, which may lock the shifting key 120 radially against the flow control device 112.

The actuation assembly 344 may further include a first retraction spring 480 and a second retraction spring 482. The first retraction spring 480 may be disposed between a first suspension rod shoulder 484 and a first lip 486 of the housing 118. As illustrated, the first suspension rod shoulder 484 may be formed at the first distal end 428 of the first suspension rod 308, and the first lip 486 may be formed at the first inner axial end 406 of the first section 300 of the housing 118. As set forth above, the first inner axial end 406 is disposed at a portion of the first section 300 adjacent to the center section 312. Further, the first retraction spring 480 is configured to bias the first suspension rod shoulder 484 away from the first lip 486 of the housing 118. That is, the first retraction spring 480 may be configured to bias the first suspension rod 308 away from the center section 312 such that the first retraction spring 480 ultimately biases the shifting key 120 to move from the expanded position toward the retracted position.

Similarly, the second retraction spring 482 may be disposed between a second suspension rod shoulder 488 and a second lip 490 of the housing 118. As illustrated, the second suspension rod shoulder 488 may be formed at the second distal end 452 of the second suspension rod 310, and the second lip 490 may be formed at the second inner axial end 416 of the second section 302 of the housing 118. As set forth above, the second inner axial end 416 is disposed at a portion of the second section 302 adjacent to the center section 312. Further, the second retraction spring 482 is configured to bias the second suspension rod shoulder 488 away from the second lip 490 of the housing 118. That is, the second retraction spring 482 may be configured to bias the second suspension rod 310 away from the center section 312 such that the second retraction spring 482 ultimately biases the shifting key 120 to move from the expanded position toward the retracted position.

FIG. 5 illustrates a cross-sectional view of the downhole service tool with the shifting key disposed in the deployed position to actuate a flow control device, in accordance with some embodiments of the present disclosure. In the shifting mode, the downhole service tool 102 may be moved uphole and downhole with the shifting key 120 latched to the flow control device 112 to increase or decrease flow through the flow control device 112.

Moreover, to engage the flow control device 112 in the shifting mode, the first piston 304 and/or the second piston 306 may actuate to drive the first linkage base 316 and the second linkage base 318 toward each other along the center section 312 such that the shifting key 120 moves from the collapsed position toward the expanded position. Once expanded, the first linkage base 316 and the second linkage base 318 may be configured to shifting together along the center section 312 of the housing 118 to drive the drive either the first linkage base 316 into contact with the first shoulder 348 or the second linkage base 318 into contact with the second shoulder 346. For example, as illustrated, the first linkage base 316 has been driven into contact with the first shoulder 348 of the housing 118 such that a load on the shifting key 120 may be transferred from the shifting key 120 through the first linkage arm 322 and the first linkage base 316 to the housing 118.

The first linkage base 316 and/or the second linkage base 318 may be configured to shift in a first axial direction 500 (e.g., to drive the first linkage base 316 into contact with the first shoulder 348) or a second axial direction 502 (e.g., to drive the second linkage base 318 into contact with the second shoulder 346) along the center section 312 in response to the load on the shifting key 120 generated via contact between the shifting key 120 and the flow control device 112 as the housing flow control device 112 moves along the wellbore 104. For example, the shifting key 120 may latch against the flow control device 112 in the shifting mode. The flow control device 112 may be fixed in the wellbore 104 such that, as the downhole service tool 102 moves in the second axial direction 502 (e.g., the uphole direction), the interface between the shifting key 120 and the flow control device 112 may apply an axially downward load to the shifting key 120. Such load may be transferred through the first linkage arm 322 to the first linkage base 316. The load may be greater than the axial force applied to the first linkage base 316 via the first piston 304 such that the first linkage base 316 may move the in the first axial direction 500 and into contact with the first shoulder 348 of the housing 118. Such movement of the first linkage base 316 may also drive the first piston 304 in the first axial direction 500. However, the first linkage base 316 is configured to contact the first shoulder 348 of the housing 118 before the first piston 304 contacts the first outer axial end 408 of the first cavity 404 such that the entire load is transferred to the housing 118 through the first linkage base 316 and not through the first piston 304, which may allow for a reliable and stable platform without causing excess wear and damage to components (e.g., the pistons, suspension springs, etc.) disposed within housing 118. Indeed, the first piston 304 is axially offset from the first end feature 410 with the shifting key 120 disposed in the expanded position and with the first linkage base 316 disposed against the first shoulder 348 of the housing 118.

Additionally, the second linkage base 318 may also move axially along the center section 312 toward first linkage base 316 in response to movement of the first linkage base 316 toward the first shoulder 348 such that the shifting key 120 is maintained against the flow control device 112. Moreover, after shifting operations are complete (e.g., the flow control device 112 is adjusted to increase or decrease the flow through the flow control device 112 as desired), pressure in the first outer hydraulic chamber 412 and the second outer hydraulic chamber 422 may be reduced such that the first retraction spring 480 and the second retraction spring 482 may bias the first linkage base 316 and the second linkage base 318 away from each other to retract the shifting key 120 from the expanded position toward the collapsed position. In the collapsed position, the downhole service tool 102 may be repositioned to another portion of the flow control device 112, to another flow control device 112, and/or may be pulled out-of-hole.

Figure 6:
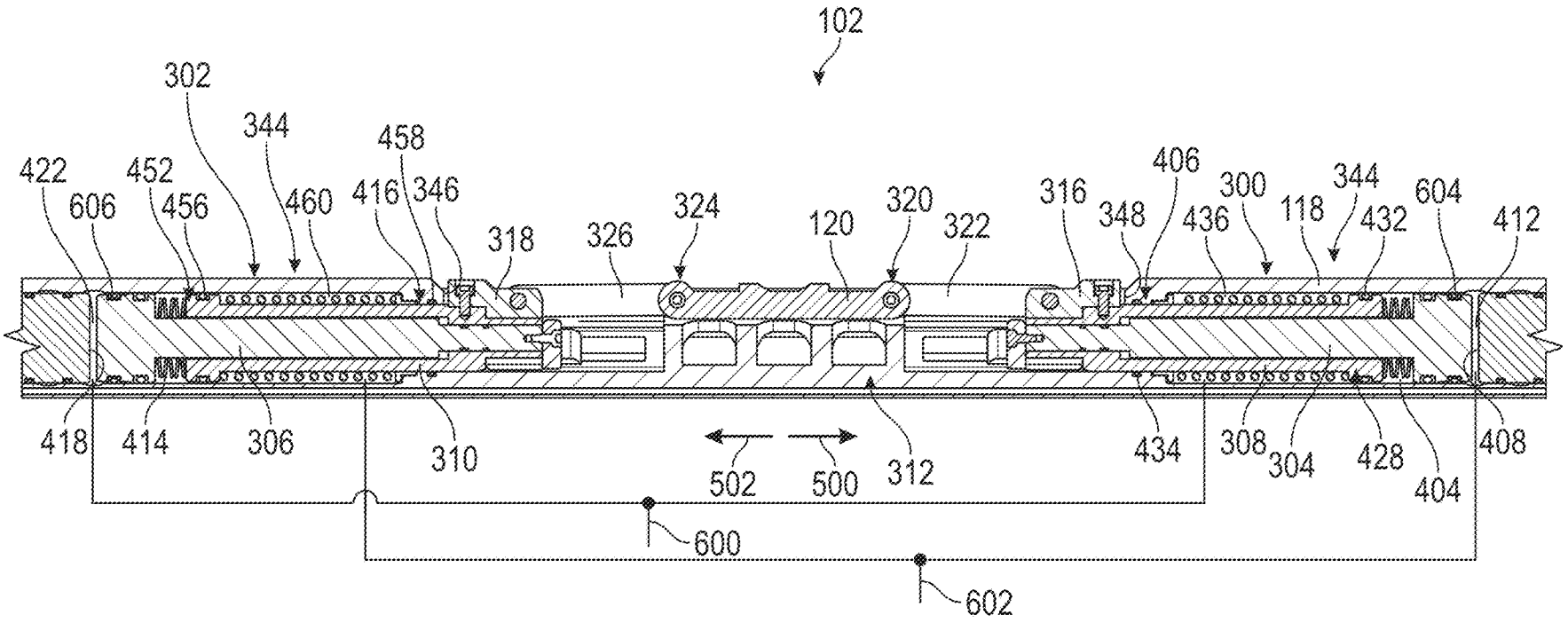
FIG. 6 illustrates a cross-sectional view of the downhole service tool having a plurality of hydraulic lines for unidirectional piston movement, in accordance with some embodiments of the present disclosure.

FIG. 6 illustrates a cross-sectional view of the service tool having a plurality of hydraulic lines for unidirectional piston movement, in accordance with some embodiments of the present disclosure. As illustrated, the actuation assembly 344 may include a first hydraulic line 600 and a second hydraulic line 602 (shown schematically) configured to each drive unidirectional piston movement. For example, the first hydraulic line 600 may be configured to drive the first linkage base 316 and the second linkage base 318 in the first axial direction 500 such that the first linkage base 316 contacts the first shoulder 348 and the second linkage base 318 moves away from the second shoulder 346 toward the first linkage base 316. Further, the second hydraulic line 602 may be configured to drive the first linkage base 316 and the second linkage base 318 in the second axial direction 502 such that the second linkage base 318 contacts the second shoulder 346 and the first linkage base 316 moves away from the first shoulder 348 toward the second linkage base 318. The actuation assembly 344 may include any suitable components (e.g., pumps, valves, etc.) for pressurizing the first hydraulic line 600 and the second hydraulic line 602. The actuation assembly 344 may be configured to selectively activate either the first hydraulic line 600 or the second hydraulic line 602 during operation of the downhole service tool 102.

As set forth above, the downhole service tool 102 may include the housing 118 securable to the conveyance 106 (shown in FIG. 1), the first piston 304 at least partially disposed within a first section 300 of the housing 118, and the second piston 306 at least partially disposed within a second section 302 of the housing 118. Further, as illustrated, the first linkage base 316 may be disposed proximate, but offset from, the first shoulder 348 of the housing 118 in a collapsed position, may be configured to move axially along a center section 312 of the housing 118 in response to actuation of the first piston 304. Similarly, the second linkage base 318 may be disposed proximate, but offset from, the second shoulder 346 of the housing 118 in the collapsed position and may be configured to move axially along the center section 312 of the housing 118 in response to actuation of the second piston 306. Additionally, the shifting key 120 is configured to move between the collapsed position and an expanded position in response to movement of the first linkage base 316 and/or the second linkage base 318. The first end 320 of the shifting key 120 is secured to the first linkage base 316 via the at least one first linkage arm 322, the second end 324 of the shifting key 120 is secured to the second linkage base 318 via the at least one second linkage arm 326.

Moreover, as set forth above, the first piston 304 may be configured to actuate toward the center section 312 of the housing 118 to drive movement of the first linkage base 316 in response to pressurization of the first outer hydraulic chamber 412. The first outer hydraulic chamber 412 may be defined as a portion of the first cavity 404 disposed between a first piston seal 604 and the first outer axial end 408 of the first cavity 404. As illustrated, the first piston seal 604 may be disposed about the first piston shoulder 472. Further, the second piston 306 may be configured to actuate toward the center section 312 of the housing 118 to drive movement of the second linkage base 318 in response to pressurization of the second outer hydraulic chamber 422. The second outer hydraulic chamber 422 may be defined as a portion of the second cavity 414 disposed between a second piston seal 606 and the second outer axial end 418 of the second cavity 414. As illustrated, the second piston seal 606 may be disposed about the second piston shoulder 476.

Further, as set forth above, the first inner hydraulic chamber 436 may be defined as the portion of the first cavity 404 disposed between the first outer slide ring 432 (e.g., disposed about the first distal end 428 of the first suspension rod 308) and the first inner slide ring 434 (e.g., disposed at the first inner axial end 406 of the first cavity 404). The first inner hydraulic chamber 436 may be pressurized to drive movement of the first linkage base 316 toward the first shoulder 348. Additionally, the second inner hydraulic chamber 460 may be defined as the portion of the second cavity 414 disposed between the second outer slide ring 456 (e.g., disposed about the second distal end 452 of the second suspension rod 310) and the second inner slide ring 458 (e.g., disposed at the second inner axial end 416 of the second cavity 414). The second inner hydraulic chamber 460 may be pressurized to drive movement of the second linkage base 318 toward the second shoulder 346.

Moreover, as set forth above, the first hydraulic line 600 may be configured to drive the first linkage base 316 and the second linkage base 318 in the first axial direction 500 such that the first linkage base 316 contacts the first shoulder 348 and the second linkage base 318 moves away from the second shoulder 346 toward the first linkage base 316. In particular, the first hydraulic line 600 may be configured to pressurize the first inner hydraulic chamber 436 disposed within the first section 300 of the housing 118 and the second outer hydraulic chamber 422 disposed within the second section 302 of the housing 118. Pressurizing the first inner hydraulic chamber 436 may drive the first piston 304 in a first axial direction 500 away from the center section 312 to move the first linkage base 316 into contact with the first shoulder 348 of the housing 118. Further, pressurizing the second outer hydraulic chamber 422 may drive the second piston 306 in the first axial direction 500 to move the second linkage base 318 toward the first linkage base 316 and drive the shifting key 120 toward the expanded position.

Further, as set forth above, the second hydraulic line 602 may be configured to drive the first linkage base 316 and the second linkage base 318 in the second axial direction 502 such that the second linkage base 318 contacts the second shoulder 346 and the first linkage base 316 moves away from the first shoulder 348 toward the second linkage base 318. In particular, the second hydraulic line 602 may be configured to pressurize the first outer hydraulic chamber 412 disposed within the first section 300 of the housing 118 and the second inner hydraulic chamber 460 disposed within the second section 302 of the housing 118. Pressurizing the second inner hydraulic chamber 460 may drive the second piston 306 in a second axial direction 502 away from the center section 312 to move the second linkage base 318 into contact with the second shoulder 346 of the housing 118. Further, pressurizing the first outer hydraulic chamber 412 may drive the first piston 304 in the second axial direction 502 to move the first linkage base 316 toward the second linkage base 318 and drive the shifting key 120 toward the expanded position.

Figure 7:
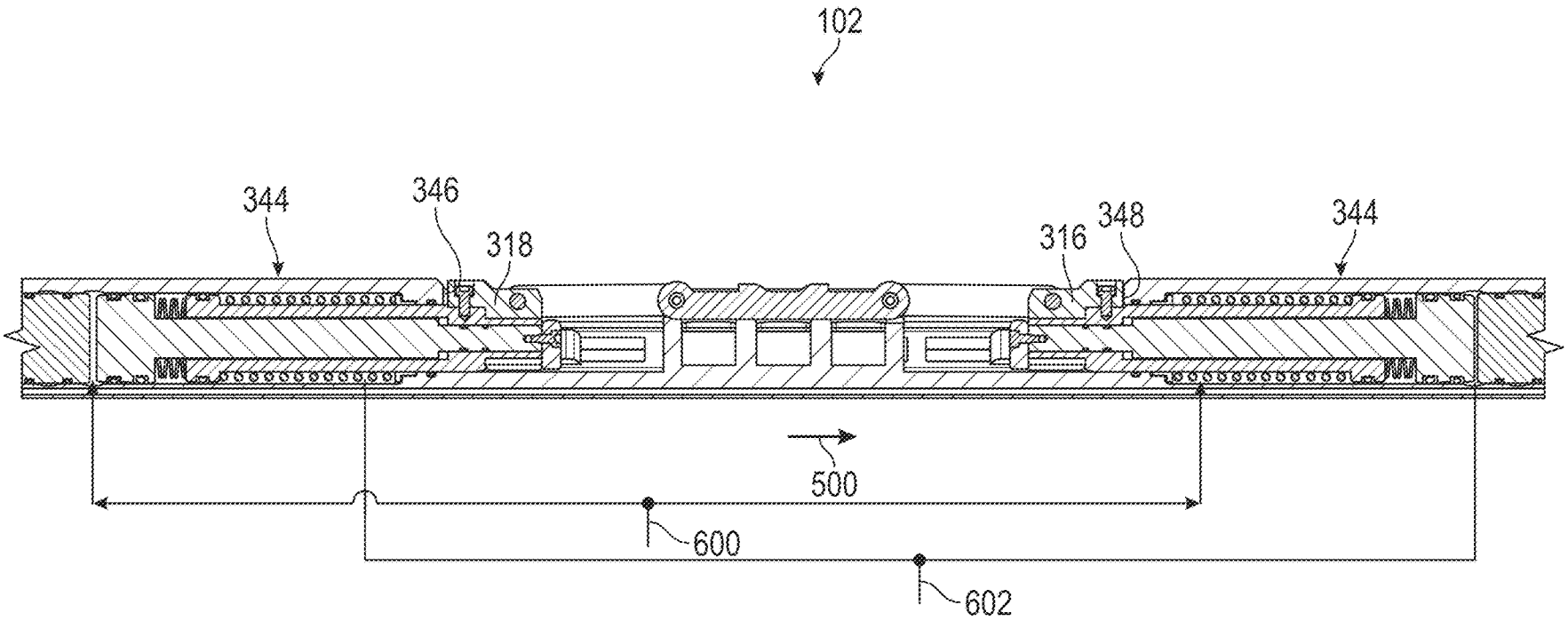
FIG. 7 illustrates a cross-sectional view of the downhole service tool having a linkage base engaged with a housing shoulder in response to unidirectional piston movement, in accordance with some embodiments of the present disclosure.

FIG. 7 illustrates a cross-sectional view of the downhole service tool having a linkage base engaged with a housing shoulder in response to unidirectional piston movement, in accordance with some embodiments of the present disclosure. As set forth above, the actuation assembly 344 may activate the first hydraulic line 600 or the second hydraulic line 602 during operation of the downhole service tool 102. For example, as illustrated, the first hydraulic line 600 has been pressurized to drive the first linkage base 316 and the second linkage base 318 in the first axial direction 500 such that the first linkage base 316 contacts the first shoulder 348 and the second linkage base 318 moves away from the second shoulder 346 toward the first linkage base 316.

Figure 8:
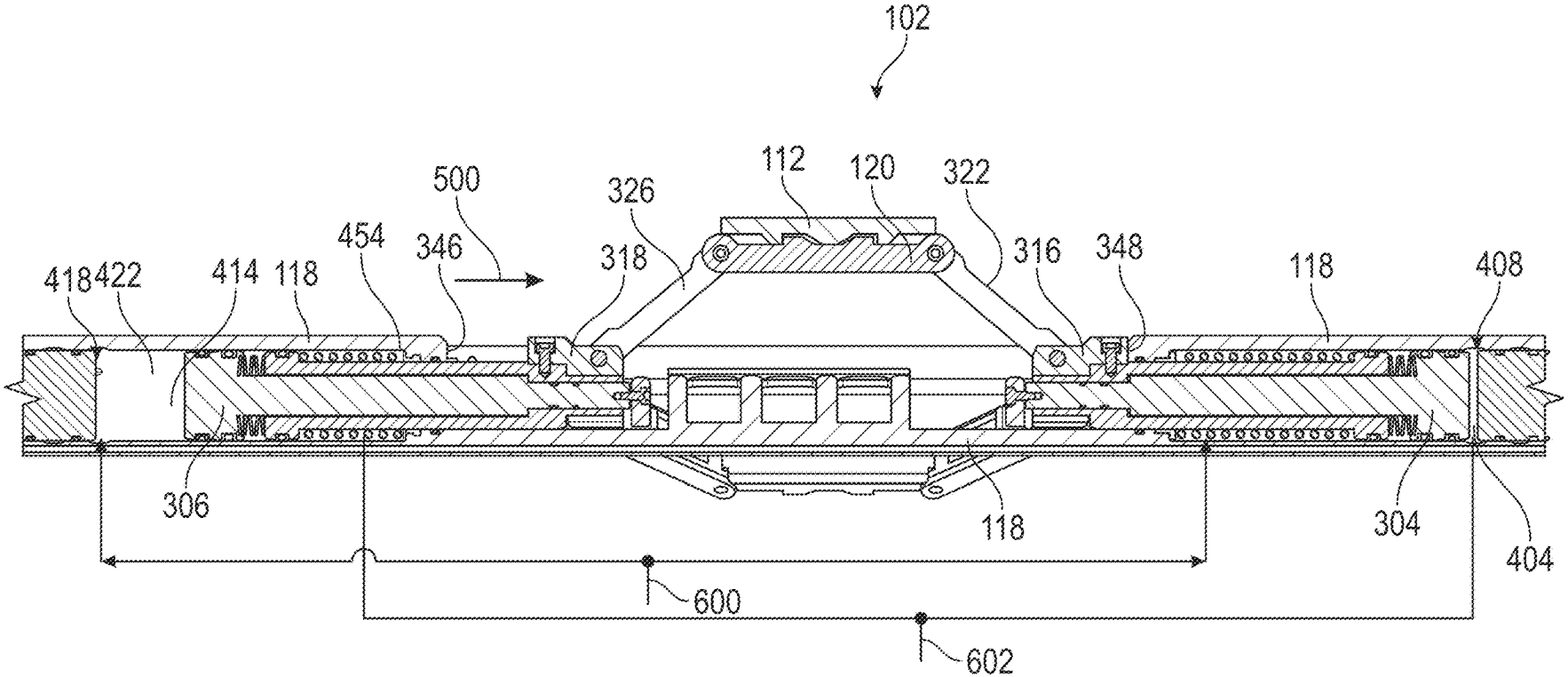
FIG. 8 illustrates a cross-sectional view of the downhole service tool with the shifting key disposed in the deployed position, in response to unidirectional piston movement, in accordance with some embodiments of the present disclosure.

FIG. 8 illustrates a cross-sectional view of the service tool with the shifting key disposed in the deployed position, in response to unidirectional piston movement, in accordance with some embodiments of the present disclosure. As set forth above, pressurizing the first hydraulic line 600 may drive the first linkage base 316 into the first shoulder 348 of the housing 118 and the second linkage base 318 in the first axial direction 500 toward the first linkage base 316. As illustrated, once the first linkage base 316 contacts the first shoulder 348, the pressurization of the second outer hydraulic chamber 422, via the first hydraulic line 600, may continue to drive the second linkage base 318 in the first axial direction 500 toward the second linkage base 318, which may force the first linkage arm 322 and the second linkage arm 326 to rotate outward and move the shifting key 120 of the downhole service tool 102 from the collapsed position toward the expanded position as shown.

As set forth above, with the shifting key 120 in the expanded position, the shifting key 120 may engage the flow control device 112. In the shifting mode, the interface between the shifting key 120 and the flow control device 112 may result in a load on the shifting key 120. The load on the shifting key 120 may be transferred to the housing 118 through the first linkage arm 322 and the first linkage base 316 via contact between the first linkage base 316 and the housing 118. Further, as set forth above, the first piston 304 may be axially offset from the first outer axial end 408 of the first cavity 404 such that the entire load is transferred to the housing 118 via the first linkage base 316. Additionally, the second linkage base 318 may be offset from the second shoulder 346 and the second piston 306 may be offset from the second outer axial end 418 of the second cavity 414 such that the first linkage base 316 may exclusively transfer the load to the housing 118.

Although the downhole service tool 102 is illustrated with the first hydraulic line 600 activated. The second hydraulic line 602 may alternatively be activated to drive the second linkage base 318 into contact with the second shoulder 346 such that the load on the shifting key 120 may be transferred to the housing 118 via the second linkage base 318.

Figure 9:
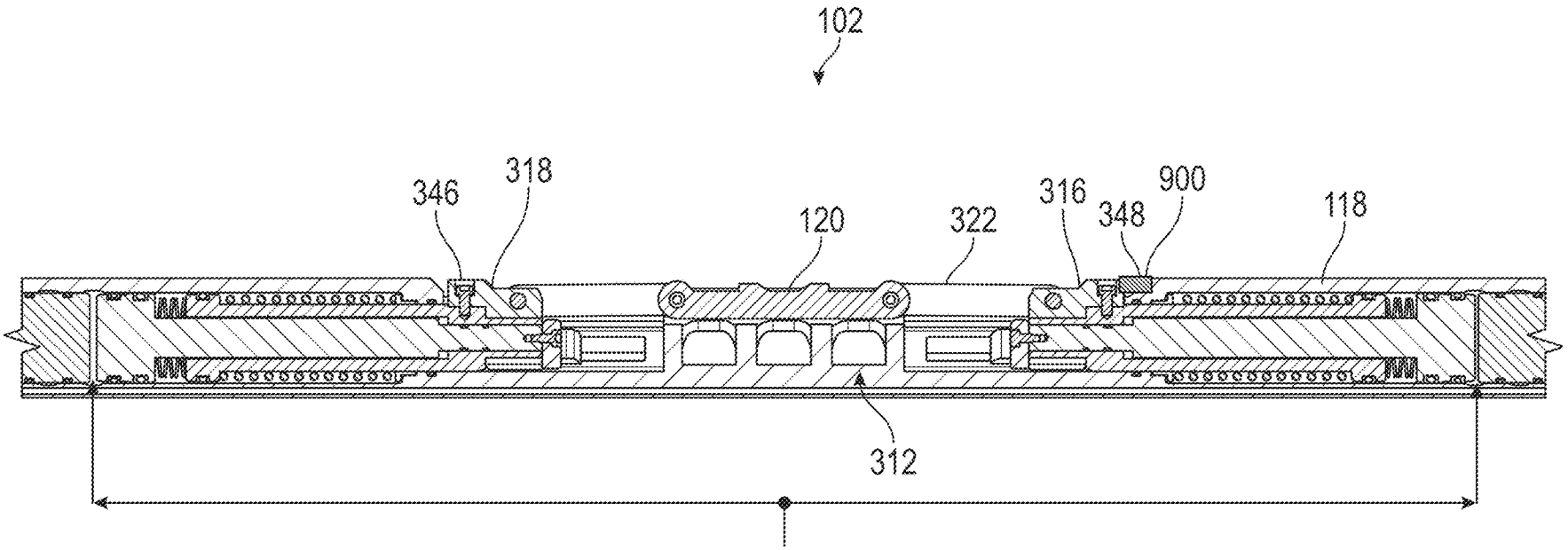
FIG. 9 illustrates a cross-sectional view of the downhole service tool with the shifting key disposed in the collapsed position and with a first linkage base pre-secured to a corresponding housing shoulder, in accordance with some embodiments of the present disclosure.

FIG. 9 illustrates a cross-sectional view of the downhole service tool with the shifting key disposed in the collapsed position and with a first linkage base pre-secured to a corresponding housing shoulder, in accordance with some embodiments of the present disclosure. As illustrated, the downhole service tool 102 may include the first linkage base 316 rigidly secured to the first shoulder 348 of the housing 118 via at least one base fastener 900 such that the first linkage base 316 contacts the first shoulder 348 in both the collapsed position and the expanded position of the shifting key 120. The at least one base fastener 900 may include any suitable fastener (e.g., a bolt, a screw, welding, etc.) or combination of fasteners. Alternatively, the first linkage base 316 may be a portion of the housing 118 such that the first linkage arm 322 is secured directly to the housing 118.

Securing the first linkage base 316 to the first shoulder 348 may prevent the first linkage base 316 from floating in the center section 312 of the housing 118. However, as illustrated, the second linkage base 318 may float in the center section 312 in the collapsed position. That is, the second linkage base 318 may be axially offset from the second shoulder 346 in the collapsed position.

Figure 10:
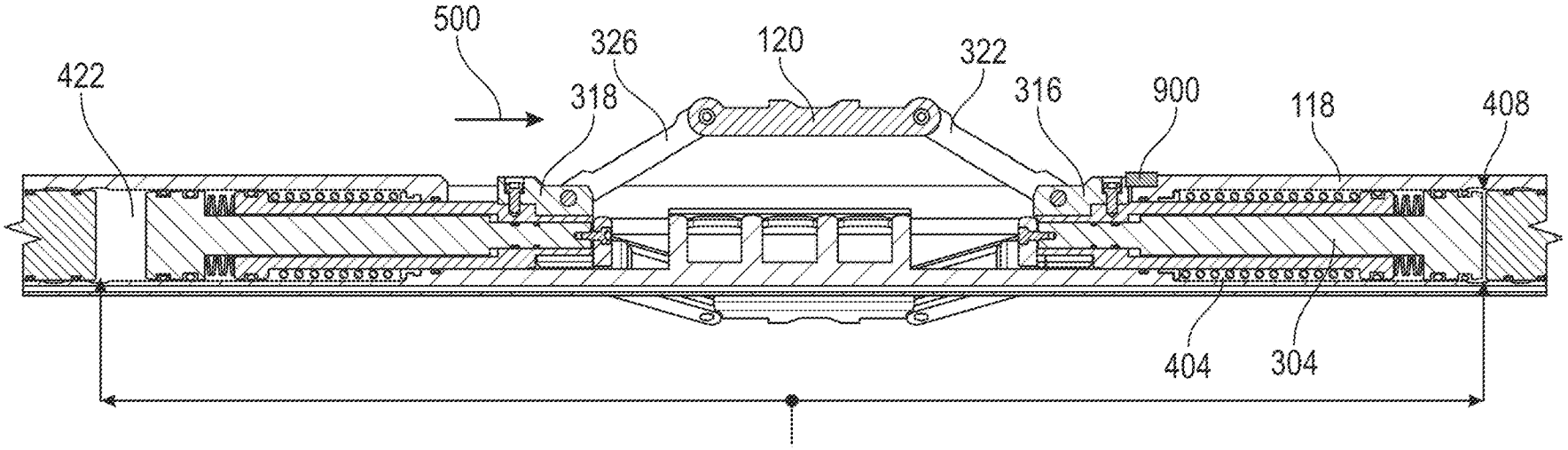
FIG. 10 illustrates a cross-sectional view of the downhole service tool with the shifting key disposed in the deployed position and with the first linkage base pre-secured to a corresponding housing shoulder, in accordance with some embodiments of the present disclosure.

FIG. 10 illustrates a cross-sectional view of the service tool with the shifting key disposed in the deployed position and with the first linkage base pre-secured to a corresponding housing shoulder, in accordance with some embodiments of the present disclosure. As illustrated, the second linkage base 318 may be configured to move in the first axial direction 500 toward the first linkage base 316 in response to pressurization of the second outer hydraulic chamber 422. As the first linkage base 316 is secured to the housing 118, via the at least one base fastener 900, the first linkage base 316 may remain stationary. Accordingly, initial movement of the second linkage base 318 may drive the second linkage base 318 toward the first linkage base 316, which may force the first linkage arm 322 and the second linkage arm 326 to rotate outward and move the shifting key 120 from the collapsed position toward the expanded position as shown.

Further, as set forth above, the shifting key 120 may engage the flow control device 112 in the expanded position, as shown in FIG. 5 and FIG. 8. In the shifting mode of the downhole service tool 102, the interface between the shifting key 120 and the flow control device 112 may result in a load on the shifting key 120. The load on the shifting key 120 may be transferred from the shifting key 120 to the housing 118 through the first linkage arm 322 and the first linkage base 316, which is secured to the first shoulder 348 of the housing 118. Further, as set forth above, the first piston 304 may be axially offset from the first outer axial end 408 of the first cavity 404 such that the entire load is transferred to the housing 118 via the first linkage base 316.

Figure 11A:
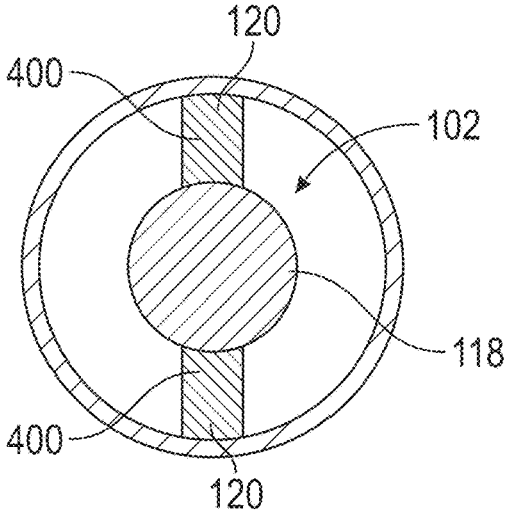
FIGS. 11A-C illustrate respective profile views of downhole services tools centered in respective wellbores via corresponding linkages and/or shifting keys, in accordance with some embodiments of the present disclosure.
Figure 11B:
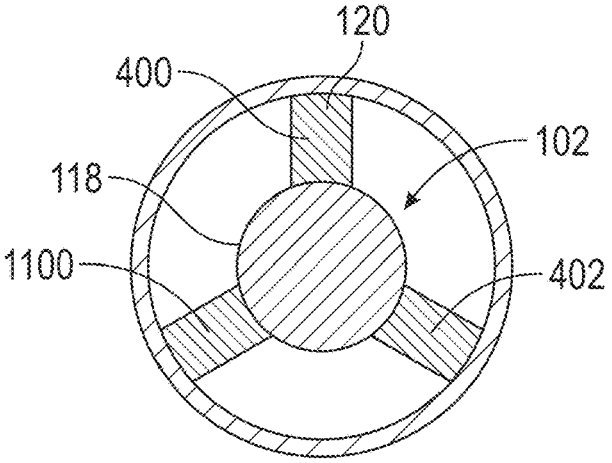
Figure 11C:
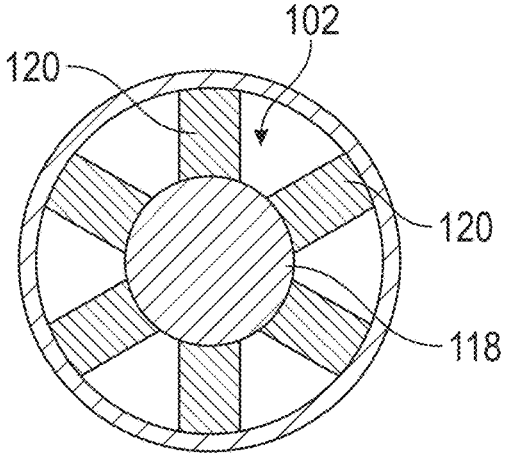

FIGS. 11A-C illustrate respective profile views of downhole services tools centered in respective wellbores via corresponding linkages and/or shifting keys, in accordance with some embodiments of the present disclosure. As illustrated in FIG. 11A, the downhole service tool 102 may include two shifting keys 120 (e.g., the first shifting key 400 and the second shifting key 402), which may be disposed on opposing side of the housing 118. That is, the first shifting key 400 may be circumferentially offset from the second shifting key 402 by about one hundred and eighty degrees.

FIG. 11B illustrates the downhole service tool 102 having three shifting keys 120 (e.g., the first shifting key 400, the second shifting key 402, and the third shifting key 1100. The shifting keys 120 may be spaced apart equally about the circumference of the housing 118. Accordingly, as illustrated, the shifting keys 120 may be spaced apart one hundred and twenty degrees from each other. Alternatively, the shifting keys 120 may be spaced unequally apart.

FIG. 11C illustrates the downhole service tool 102 having six shifting keys 120 that are spaced sixty degrees from each other about the circumference of the housing 118. Each shifting key 120 may include a respective first linkage base 316 and a respective second linkage base 318. Further, the first piston 304 may be configured to actuate all of the first linkage bases 316 (shown in FIG. 3). Similarly, the second piston 306 may be configured to actuate all of the second linkage bases 318 (shown in FIG. 3). Alternatively, the downhole service tool 102 may include individual first pistons 304 and second pistons 306 corresponding to each respective first linkage base 316 and second linkage base 318 such that each shifting key 120 may be individually actuated.

Figure 12:
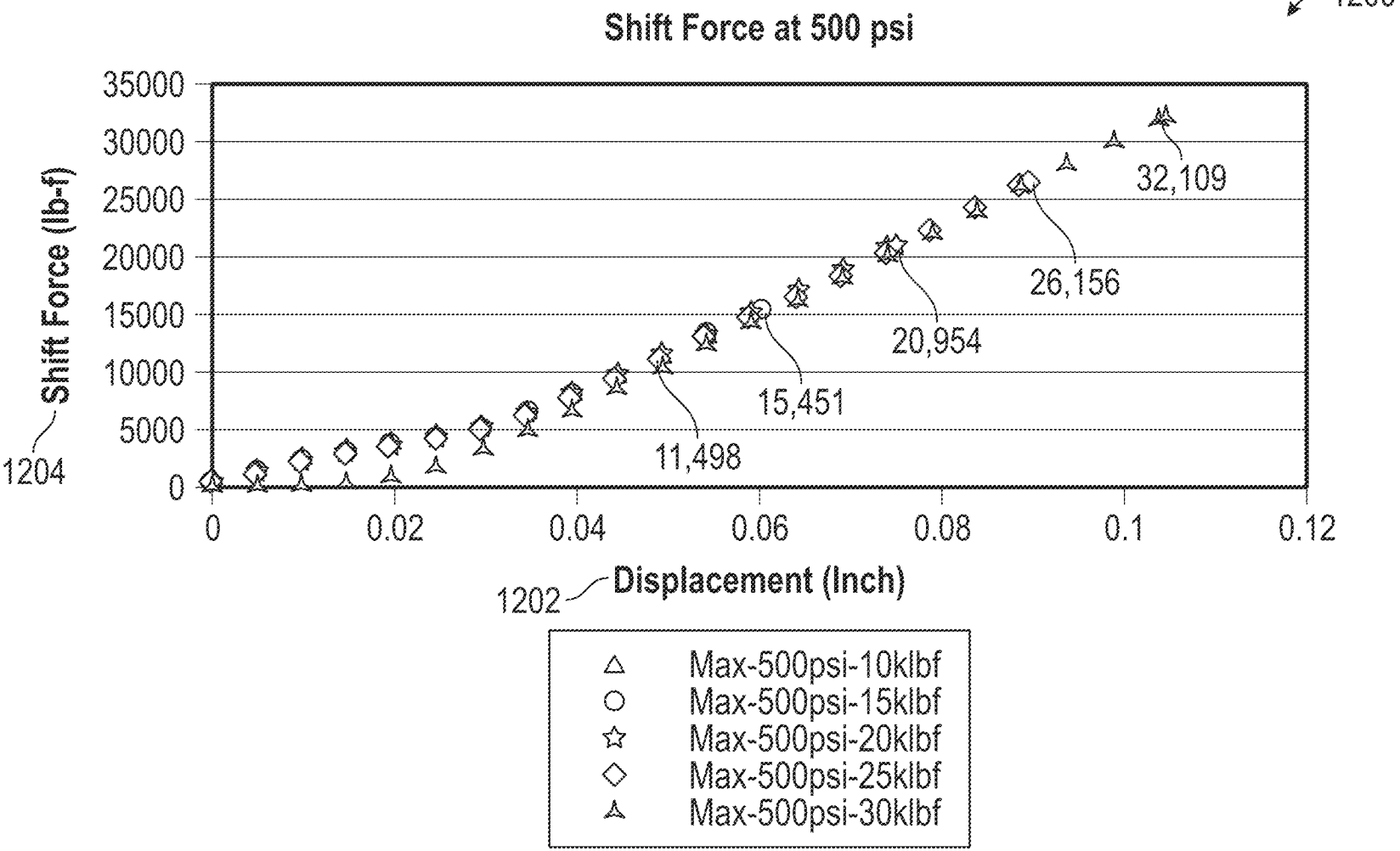
FIG. 12 is a graph mapping a shift force utilized by the downhole service tool during a shifting operation, in accordance with some embodiments of the present disclosure.

FIG. 12 is a graph mapping a shift force utilized by the downhole service tool during a shifting operation, in accordance with some embodiments of the present disclosure. In particular, the graph 1200 maps displacement 1202 of the latch interface in response to a shift force 1204 applied via movement of the downhole service tool 102 with the shifting key 120 engaged with the flow control device 112 (shown in FIG. 5). The amount of displacement 1202 of the flow control device 112 may correlate to a degree of adjustment of the flow control device 112.

The method and systems described above are an improvement over current downhole service tools. For examples, the suspension system described above is not connected to the high pressure chamber. This may enable lower stiffness of the shifting mechanism to run across the shifting profile and centralization. During shifting, the linkages transfer to load directly through the housing, hence significantly improve the load capacity. Additionally, a potentiometer may be added to confirm shifting diameter and as confirmation of shifting profile, enable accurate placement of the shifting key to the shifting profile.

Accordingly, the present disclosure may provide a service tool having a suspension system to enable a shifting key to run across a latching profile mechanically with minimal pressure. The methods and systems may include any of the various features disclosed herein, including one or more of the following statements.

Statement 1. A downhole system, comprising: a housing securable to a conveyance; a first linkage base disposed proximate a first shoulder of the housing in a collapsed position; a second linkage base disposed proximate a second shoulder of the housing in the collapsed position, wherein the first linkage base and/or the second linkage base are configured to move axially along a center section of the housing in response to actuation of an actuation assembly; and a shifting key configured to move between the collapsed position and an expanded position in response to movement of the first linkage base and/or the second linkage base, wherein a first end of the shifting key is secured to the first linkage base via at least one first linkage arm, and wherein a second end of the shifting key is secured to the second linkage base via at least one second linkage arm, and wherein the first linkage base is configured to contact the first shoulder of the housing, with the shifting key in the expanded position, to transfer a load on the shifting key to the housing through the first linkage arm and the first linkage base.

Statement 2. The downhole system of statement 1, wherein the shifting key is configured to move toward the expanded position in response to the first linkage base and the second linkage base moving toward each other along the center section of the housing, and wherein the shifting key is configured to move toward the collapsed position in response to the first linkage base and the second linkage base moving away from each other along the center section of the housing.

Statement 3. The downhole system of statement 1, wherein the first linkage base and/or the second linkage base, with the shifting key in the expanded position, are configured to shift together along the center section to drive the first linkage base into contact with the first shoulder of the housing such that the load on the shifting key is transferred from the shifting key through the first linkage arm and the first linkage base to the housing.

Statement 4. The downhole system of statement 1, wherein the first linkage base and/or the second linkage base, with the shifting key in the expanded position, are configured to shift together in a first axial direction or a second axial direction along the center section to drive the first linkage base into contact with the first shoulder of the housing or the second linkage base into contact with the second shoulder of the housing such that the load on the shifting key is transferred from the shifting key to the housing through the first linkage arm and the first linkage base or from the shifting key to the housing through the second linkage arm and the second linkage base, respectively.

Statement 5. The downhole system of statement 1, wherein the first linkage base and/or the second linkage base are configured to shift, with the shifting key in the expanded position, in a first axial direction and/or a second axial direction along the center section in response to the load on the shifting key generated via contact between the shifting key and a downhole tool as the housing moves along a wellbore.

Statement 6. The downhole system of statement 1, wherein the first linkage base and/or the second linkage base are configured to shift, with the shifting key in the expanded position, in a first axial direction and/or a second axial direction along the center section in response to actuation of the actuation assembly.

Statement 7. The downhole system of statement 1, wherein the actuation assembly comprises: a first piston at least partially disposed within a first section of the housing, wherein the first piston is configured to actuate toward the center section of the housing in response to pressurization of a first hydraulic chamber of the first section, wherein actuation of the first piston is configured to drive movement of the first linkage base; and a second piston at least partially disposed within a second section of the housing, wherein the second piston is configured to actuate toward the central section of the housing in response to pressurization of a second hydraulic chamber of the second section, wherein actuation of the second piston is configured to drive movement of the second linkage base.

Statement 8. The downhole system of statement 7, wherein the first section of the housing includes a first cavity for housing at least a portion of the first piston, wherein the first cavity includes an inner axial end disposed adjacent the center section and an outer axial end disposed opposite the inner axial end, wherein the inner axial end is open such that the at least a portion of the first piston may move through the inner axial end and into the center section, wherein the first cavity is sealed at an outer axial end via a first end feature, and wherein the first piston is axially offset from the first end feature in the collapsed position of the shifting key.

Statement 9. The downhole system of statement 8, wherein the first piston is axially offset from the first end feature with the shifting key disposed in the expanded position and with the first linkage base disposed against the first shoulder of the housing.

Statement 10. The downhole system of statement 7, wherein the at least one actuation assembly comprises: a first suspension rod having a proximal end rigidly secured to the first linkage base via at least one fastener such that movement of the first suspension rod drives movement of the first linkage base, wherein a distal end of the first suspension rod is disposed within the first section of the housing, wherein the first suspension rod includes a first bore configured to house at least a portion of the first piston, and wherein actuation of the first piston is configured to drive the first suspension rod to move axially with respect to the housing; and second suspension rod having a proximal end rigidly secured to the second linkage base via at least one fastener such that movement of the second suspension rod drives movement of the second linkage base, wherein a distal end of the second suspension rod is disposed within the second section of the housing, wherein the second suspension rod includes a second bore configured to house at least a portion of the second piston, and wherein actuation of the second piston is configured to drive the second suspension rod to move axially with respect to the housing.

Statement 11. The downhole system of statement 1, wherein the at least one actuation assembly comprises: a first suspension spring disposed between a distal end of the first suspension rod and a first piston shoulder formed at a distal end of the first piston, wherein the first suspension spring is configured to bias the first suspension rod away from the first piston; and a second suspension spring disposed between a distal end of the second suspension rod and a second piston shoulder formed at a distal end of the second piston, wherein the second suspension spring is configured to bias the second suspension rod away from the second piston, wherein the second suspension spring is configured to bias the second suspension rod to a corresponding position for holding the shifting key in the expanded position with the second piston actuated toward the center section of the housing, and wherein the second suspension spring is compressible in response to the shifting key contacting a downhole tool as the housing moves along a wellbore.

Statement 12. The downhole system of statement 1, wherein the at least one actuation assembly comprises: a first retraction spring disposed between a first suspension rod shoulder and a first lip, wherein the first suspension rod shoulder is formed at a distal end of the first suspension rod, wherein the first lip is formed at an inner axial end of the first section of the housing, wherein the inner axial end is disposed adjacent the center section, and wherein the first retraction spring is configured to bias the first suspension shoulder away from the first lip to bias the shifting key to move from the expanded position toward the retracted position; and a second retraction spring disposed between a second suspension rod shoulder and a second lip, wherein the second suspension rod shoulder is formed at a distal end of the second suspension rod, wherein the second lip is formed at an inner axial end of the second section of the housing, wherein the inner axial end is disposed adjacent the center section, and wherein the second retraction spring is configured to bias the second suspension shoulder away from the second lip to bias the shifting key to move from the expanded position toward the retracted position.

Statement 13. The downhole system of statement 1, wherein the second linkage base is axially offset from the second shoulder with the shifting key in the expanded position.

Statement 14. The downhole system of statement 1, wherein the second linkage base is axially offset from the second shoulder in the collapsed position, and wherein the first linkage base is axially offset from the first shoulder in the collapsed position.

Statement 15. The downhole system of statement 1, wherein the first linkage base is secured to the first shoulder via at least one fastener such that the first linkage base contacts the first shoulder in both the collapsed position and the expanded position of the shifting key.

Statement 16. The downhole system of statement 1, wherein the first shoulder is disposed at an upper axial end of a lower section of the housing, wherein the second shoulder is disposed at a lower axial end of an upper section of the housing, and wherein the center section of the housing disposed axially between the upper section and the lower section.

Statement 17. A downhole system, comprising: a housing securable to a conveyance; a first piston at least partially disposed within a first section of the housing; a second piston at least partially disposed within a second section of the housing; a first linkage base disposed proximate a first shoulder of the housing in a collapsed position, wherein the first linkage base is configured to move axially along a center section of the housing in response to actuation of the first piston; a second linkage base disposed proximate a second shoulder of the housing in the collapsed position, wherein the second linkage base is configured to move axially along the center section of the housing in response to actuation of the second piston; a shifting key configured to move between the collapsed position and an expanded position in response to movement of the first linkage base and/or the second linkage base, wherein a first end of the shifting key is secured to the first linkage base via at least one first linkage arm, and wherein a second end of the shifting key is secured to the second linkage base via at least one second linkage arm; and a first hydraulic line configured to pressurize a first inner hydraulic chamber disposed within the first section of the housing and a second outer hydraulic chamber disposed within the second section of the housing, wherein pressurization of the first inner hydraulic chamber drives the first piston in a first axial direction away from the center section to move the first linkage base into contact with the first shoulder of the housing, wherein pressurization of the second outer hydraulic chamber drives the second piston in the first axial direction to move the second linkage base toward the first linkage base and drive the shifting key toward the expanded position, and wherein a load on the shifting key from the shifting key engaging a downhole tool in the expanded position is transferred to the housing through the first linkage arm and the first linkage base contacting the first shoulder.

Statement 18. The downhole system of statement 17, further comprising a second hydraulic line configured to pressurize a first outer hydraulic chamber disposed within the first section of the housing and a second inner hydraulic chamber disposed within the second section of the housing, wherein pressurization of the second inner hydraulic chamber drives the second piston in a second axial direction away from the center section to move the second linkage base into contact with the second shoulder of the housing, wherein pressurization of the first outer hydraulic chamber drives the first piston in the second axial direction to move the first linkage base toward the second linkage base and drive the shifting key toward the expanded position, and wherein a load on the shifting key from the shifting key engaging a downhole tool in the expanded position is transferred to the housing through the second linkage arm and the second linkage base contacting the second shoulder.

Statement 19. The downhole system of statement 17, wherein the first piston comprises a first piston shoulder formed at a distal end of the first piston, wherein the first section of the housing includes a first cavity for housing at least the first piston shoulder of the first piston, wherein the first cavity includes an inner axial end disposed adjacent the center section and an outer axial end disposed opposite the inner axial end, and wherein the first inner hydraulic chamber comprises a portion of the first cavity defined between the inner axial end and the first piston shoulder, and wherein a first outer hydraulic chamber comprises a portion of the first cavity defined between the first piston shoulder and the outer axial end.

Statement 20. A downhole system, comprising: a housing securable to a conveyance; a first linkage base rigidly secured to a first shoulder of the housing via at least one fastener; a second linkage base disposed proximate a second shoulder of the housing in the collapsed position, wherein the second linkage base is configured to move axially along a center section of the housing in response to actuation of at least one piston of an actuation assembly; and a shifting key configured to move between the collapsed position and an expanded position in response to movement of the second linkage base, wherein a first end of the shifting key is secured to the first linkage base via at least one first linkage arm, and wherein a second end of the shifting key is secured to the second linkage base via at least one second linkage arm, and wherein a load on the shifting key, in the expanded position, is transferred to the housing through the first linkage arm and the first linkage base rigidly secured to the first shoulder of the housing.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole system, comprising:

a housing securable to a conveyance;

a first linkage base disposed proximate a first shoulder of the housing in a collapsed position;

a second linkage base disposed proximate a second shoulder of the housing in the collapsed position, wherein the first linkage base and the second linkage base are configured to move axially along a center section of the housing in response to actuation of an actuation assembly; and a shifting key configured to move between the collapsed position and an expanded position in response to movement of the first linkage base and the second linkage base, wherein a first end of the shifting key is secured to the first linkage base via at least one first linkage arm, and wherein a second end of the shifting key is secured to the second linkage base via at least one second linkage arm, and wherein the first linkage base is configured to contact the first shoulder of the housing, with the shifting key in the expanded position, to transfer a load on the shifting key to the housing through the first linkage arm and the first linkage base.

2. The downhole system of claim 1, wherein the shifting key is configured to move toward the expanded position in response to the first linkage base and the second linkage base moving toward each other along the center section of the housing, and wherein the shifting key is configured to move toward the collapsed position in response to the first linkage base and the second linkage base moving away from each other along the center section of the housing.

3. The downhole system of claim 1, wherein the first linkage base and the second linkage base, with the shifting key in the expanded position, are configured to shift together along the center section to drive the first linkage base into contact with the first shoulder of the housing such that the load on the shifting key is transferred from the shifting key through the first linkage arm and the first linkage base to the housing.

4. The downhole system of claim 1, wherein the first linkage base and the second linkage base, with the shifting key in the expanded position, are configured to shift together in a first axial direction or a second axial direction along the center section to drive the first linkage base into contact with the first shoulder of the housing or the second linkage base into contact with the second shoulder of the housing such that the load on the shifting key is transferred from the shifting key to the housing through the first linkage arm and the first linkage base or from the shifting key to the housing through the second linkage arm and the second linkage base, respectively.

5. The downhole system of claim 1, wherein the first linkage base and the second linkage base are configured to shift, with the shifting key in the expanded position, in a first axial direction, a second axial direction, or some combination thereof, along the center section in response to the load on the shifting key generated via contact between the shifting key and a downhole tool as the housing moves along a wellbore.

6. The downhole system of claim 1, wherein the first linkage base and the second linkage base are configured to shift, with the shifting key in the expanded position, in a first axial direction, a second axial direction, or some combination thereof, along the center section in response to actuation of the actuation assembly.

7. The downhole system of claim 1, wherein the actuation assembly comprises:

a first piston at least partially disposed within a first section of the housing, wherein the first piston is configured to actuate toward the center section of the housing in response to pressurization of a first hydraulic chamber of the first section, wherein actuation of the first piston is configured to drive movement of the first linkage base; and a second piston at least partially disposed within a second section of the housing, wherein the second piston is configured to actuate toward the central section of the housing in response to pressurization of a second hydraulic chamber of the second section, wherein actuation of the second piston is configured to drive movement of the second linkage base.

8. The downhole system of claim 7, wherein the first section of the housing includes a first cavity for housing at least a portion of the first piston, wherein the first cavity includes an inner axial end disposed adjacent the center section and an outer axial end disposed opposite the inner axial end, wherein the inner axial end is open such that the at least a portion of the first piston may move through the inner axial end and into the center section, wherein the first cavity is sealed at an outer axial end via a first end feature, and wherein the first piston is axially offset from the first end feature in the collapsed position of the shifting key.

9. The downhole system of claim 8, wherein the first piston is axially offset from the first end feature with the shifting key disposed in the expanded position and with the first linkage base disposed against the first shoulder of the housing.

10. The downhole system of claim 7, wherein the at least one actuation assembly comprises:

a first suspension rod having a proximal end rigidly secured to the first linkage base via at least one fastener such that movement of the first suspension rod drives movement of the first linkage base, wherein a distal end of the first suspension rod is disposed within the first section of the housing, wherein the first suspension rod includes a first bore configured to house at least a portion of the first piston, and wherein actuation of the first piston is configured to drive the first suspension rod to move axially with respect to the housing; and a second suspension rod having a proximal end rigidly secured to the second linkage base via at least one fastener such that movement of the second suspension rod drives movement of the second linkage base, wherein a distal end of the second suspension rod is disposed within the second section of the housing, wherein the second suspension rod includes a second bore configured to house at least a portion of the second piston, and wherein actuation of the second piston is configured to drive the second suspension rod to move axially with respect to the housing.

11. The downhole system of claim 1, wherein the at least one actuation assembly comprises:

a first suspension spring disposed between a distal end of the first suspension rod and a first piston shoulder formed at a distal end of the first piston, wherein the first suspension spring is configured to bias the first suspension rod away from the first piston; and a second suspension spring disposed between a distal end of the second suspension rod and a second piston shoulder formed at a distal end of the second piston, wherein the second suspension spring is configured to bias the second suspension rod away from the second piston, wherein the second suspension spring is configured to bias the second suspension rod to a corresponding position for holding the shifting key in the expanded position with the second piston actuated toward the center section of the housing, and wherein the second suspension spring is compressible in response to the shifting key contacting a downhole tool as the housing moves along a wellbore.

12. The downhole system of claim 1, wherein the at least one actuation assembly comprises:

a first retraction spring disposed between a first suspension rod shoulder and a first lip, wherein the first suspension rod shoulder is formed at a distal end of the first suspension rod, wherein the first lip is formed at an inner axial end of the first section of the housing, wherein the inner axial end is disposed adjacent the center section, and wherein the first retraction spring is configured to bias the first suspension shoulder away from the first lip to bias the shifting key to move from the expanded position toward the retracted position; and a second retraction spring disposed between a second suspension rod shoulder and a second lip, wherein the second suspension rod shoulder is formed at a distal end of the second suspension rod, wherein the second lip is formed at an inner axial end of the second section of the housing, wherein the inner axial end is disposed adjacent the center section, and wherein the second retraction spring is configured to bias the second suspension shoulder away from the second lip to bias the shifting key to move from the expanded position toward the retracted position.

13. The downhole system of claim 1, wherein the second linkage base is axially offset from the second shoulder with the shifting key in the expanded position.

14. The downhole system of claim 1, wherein the second linkage base is axially offset from the second shoulder in the collapsed position, and wherein the first linkage base is axially offset from the first shoulder in the collapsed position.

15. The downhole system of claim 1, wherein the first linkage base is secured to the first shoulder via at least one fastener such that the first linkage base contacts the first shoulder in both the collapsed position and the expanded position of the shifting key.

16. The downhole system of claim 1, wherein the first shoulder is disposed at an upper axial end of a lower section of the housing, wherein the second shoulder is disposed at a lower axial end of an upper section of the housing, and wherein the center section of the housing disposed axially between the upper section and the lower section.

17. A downhole system, comprising:

a housing securable to a conveyance;

a first piston at least partially disposed within a first section of the housing;

a second piston at least partially disposed within a second section of the housing;

a first linkage base disposed proximate a first shoulder of the housing in a collapsed position, wherein the first linkage base is configured to move axially along a center section of the housing in response to actuation of the first piston;

a second linkage base disposed proximate a second shoulder of the housing in the collapsed position, wherein the second linkage base is configured to move axially along the center section of the housing in response to actuation of the second piston;

a shifting key configured to move between the collapsed position and an expanded position in response to movement of the first linkage base and the second linkage base, wherein a first end of the shifting key is secured to the first linkage base via at least one first linkage arm, and wherein a second end of the shifting key is secured to the second linkage base via at least one second linkage arm; and a first hydraulic line configured to pressurize a first inner hydraulic chamber disposed within the first section of the housing and a second outer hydraulic chamber disposed within the second section of the housing, wherein pressurization of the first inner hydraulic chamber drives the first piston in a first axial direction away from the center section to move the first linkage base into contact with the first shoulder of the housing, wherein pressurization of the second outer hydraulic chamber drives the second piston in the first axial direction to move the second linkage base toward the first linkage base and drive the shifting key toward the expanded position, and wherein a load on the shifting key from the shifting key engaging a downhole tool in the expanded position is transferred to the housing through the first linkage arm and the first linkage base contacting the first shoulder.

18. The downhole system of claim 17, further comprising a second hydraulic line configured to pressurize a first outer hydraulic chamber disposed within the first section of the housing and a second inner hydraulic chamber disposed within the second section of the housing, wherein pressurization of the second inner hydraulic chamber drives the second piston in a second axial direction away from the center section to move the second linkage base into contact with the second shoulder of the housing, wherein pressurization of the first outer hydraulic chamber drives the first piston in the second axial direction to move the first linkage base toward the second linkage base and drive the shifting key toward the expanded position, and wherein a load on the shifting key from the shifting key engaging a downhole tool in the expanded position is transferred to the housing through the second linkage arm and the second linkage base contacting the second shoulder.

19. The downhole system of claim 17, wherein the first piston comprises a first piston shoulder formed at a distal end of the first piston, wherein the first section of the housing includes a first cavity for housing at least the first piston shoulder of the first piston, wherein the first cavity includes an inner axial end disposed adjacent the center section and an outer axial end disposed opposite the inner axial end, and wherein the first inner hydraulic chamber comprises a portion of the first cavity defined between the inner axial end and the first piston shoulder, and wherein a first outer hydraulic chamber comprises a portion of the first cavity defined between the first piston shoulder and the outer axial end.

20. A downhole system, comprising:

a housing securable to a conveyance;

a first linkage base rigidly secured to a first shoulder of the housing via at least one fastener;

a second linkage base disposed proximate a second shoulder of the housing in the collapsed position, wherein the second linkage base is configured to move axially along a center section of the housing in response to actuation of a second piston of an actuation assembly;

a second suspension rod having a proximal end rigidly secured to the second linkage base via at least one fastener such that movement of the second suspension rod drives movement of the second linkage base, wherein a distal end of the second suspension rod is disposed within the second section of the housing, wherein the second suspension rod includes a second bore configured to house at least a portion of the second piston, and wherein actuation of the second piston is configured to drive the second suspension rod to move axially with respect to the housing; and a shifting key configured to move between the collapsed position and an expanded position in response to movement of the second linkage base, wherein a first end of the shifting key is secured to the first linkage base via at least one first linkage arm, and wherein a second end of the shifting key is secured to the second linkage base via at least one second linkage arm, and wherein a load on the shifting key, in the expanded position, is transferred to the housing through the first linkage arm and the first linkage base rigidly secured to the first shoulder of the housing.

* * * * *